US006447973B1

(12) United States Patent
Asami et al.

(10) Patent No.: US 6,447,973 B1
(45) Date of Patent: Sep. 10, 2002

(54) LIQUID DEVELOPER FOR DEVELOPING ELECTROSTATIC IMAGE AND IMAGE FORMING METHOD

(75) Inventors: Tsuyoshi Asami, Yokohama; Kazuo Tsubuko, Numazu; Aiko Ishikawa, Numazu; Akihiro Koseki, Numazu; Takeo Kudoh, Tagata-gun; Kazuhiko Umemura, Suntou-gun, all of (JP)

(73) Assignee: Ricoh Company, Ltd., Tokyo (JP)

( * ) Notice: Subject to any disclaimer, the term of this patent is extended or adjusted under 35 U.S.C. 154(b) by 9 days.

(21) Appl. No.: 09/644,266

(22) Filed: Aug. 23, 2000

(30) Foreign Application Priority Data

| | | |
|---|---|---|
| Aug. 24, 1999 | (JP) | 11-236941 |
| Oct. 4, 1999 | (JP) | 11-283475 |
| Nov. 15, 1999 | (JP) | 11-324164 |
| Nov. 22, 1999 | (JP) | 11-331437 |

(51) Int. Cl.[7] ..... G03G 9/00
(52) U.S. Cl. ..... 430/114; 430/115; 430/116
(58) Field of Search ..... 430/115, 116, 430/114

(56) References Cited

U.S. PATENT DOCUMENTS 5,783,348 A * 7/1998 Tyagi et al. ..... 430/124

* cited by examiner

*Primary Examiner*—Mark Chapman
(74) *Attorney, Agent, or Firm*—Oblon, Spivak, McClelland, Maier & Neustadt, P.C.

(57) ABSTRACT

A liquid developer containing a carrier liquid containing silicone oil, and toner particles dispersed in the carrier liquid and each containing a coloring agent and a resin, the resin contains at least one member selected from the group consisting of the following resins (a)–(g):

(a): rosin polymers having a softening point of 50–190° C., a glass transition point of 10–170° C. and a molecular weight of 2,000–40,000 and obtained by reacting
(a1) a rosin glycidyl ester,
(a2) dicarboxylic acid or dicarboxylic anhydride,
(a3) at least one crosslinking agent selected from the group consisting of polyfunctional epoxy compounds, tri- or more polybasic acids or anhydrides thereof tri- or more polyhydric alcohols, and
(a4) a dihydric alcohol;

(b): vinyl polymers having a ratio of the weight average molecular weight to the number average molecular weight of greater than 4;

(c): olefin resins having a melt index of 2.5–700;

(d): polyolefins or polyolefin copolymers having an acid value of 0.5–80 and a melt viscosity of 50–20,000 mpa·s at 200° C.;

(e): polymers obtained by crosslinking carboxyl group-containing vinyl polymers with an amine;

(f): vinyl polymers having at least 0.005% by weight of a crosslinking monomer based on a total monomer; and (g): silicone copolymers, silicone rubber or silicone-modified resins. A liquid developer containing a carrier liquid containing silicone oil, toner particles each containing a coloring agent and a resin, and an erucamide compound.

6 Claims, 2 Drawing Sheets

LIQUID DEVELOPER FOR DEVELOPING ELECTROSTATIC IMAGE AND IMAGE FORMING METHOD

BACKGROUND OF THE INVENTION

This invention relates to a liquid developer for developing electrostatic images and for use in electrophotography, electrostatic recording, electrostatic printing, etc. and to an image forming method.

Developers for electrophotography may be classified into dry developers and liquid developers. Since toners used in liquid developers have a small particle diameter of 0.1–2.0 μm, liquid developers have an advantage that a clear image can be obtained. A liquid developer is generally produced by dispersing a binder resin, a colorant and a charge controlling agent in a non-aqueous solvent carrier liquid such as an aliphatic hydrocarbon.

Fixation on a transfer medium such as paper is generally carried out using a heat roller. Conventional liquid developers have problems that solvent vapors are emanated in the atmosphere during fixation, that a silicone oil should be fed for being applied to a fixation roll and that hot offset is caused during fixation.

SUMMARY OF THE INVENTION

It is an object of the present invention to provide a liquid developer which can solve the above problems.

Another object of the present invention is to provide a liquid developer which does not require a feed of a silicone oil to a fixation roll and which can prevent both generation of solvent vapors and offset during fixation.

It is a further object of the present invention to provide a liquid developer which can permit low temperature fixation.

It is a further object of the present invention to provide an image forming method which can give images with a high image density and resolution.

In accordance with one aspect of the present invention, there is provided a liquid developer comprising a carrier liquid containing silicone oil, toner particles each containing a coloring agent and a resin, and an erucamide compound.

In another aspect, the present invention provides a liquid developer comprising a carrier liquid containing silicone oil, and toner particles dispersed in said carrier liquid and each containing a coloring agent and a resin, said resin contains at least one member selected from the group consisting of the following resins (a)–(g):

(a): rosin polymers having a softening point of 50–190° C., a glass transition point of 10–170° C. and a molecular weight of 2,000–40,000 and obtained by reacting
- (a1) a rosin glycidyl ester,
- (a2) dicarboxylic acid or dicarboxylic anhydride,
- (a3) at least one crosslinking agent selected from the group consisting of polyfunctional epoxy compounds, tri- or more polybasic acids or anhydrides thereof tri- or more polyhydric alcohols, and
- (a4) a dihydric alcohol;

(b): vinyl polymers having a ratio of the weight average molecular weight to the number average molecular weight of greater than 4;

(c): olefin resins having a melt index of 2.5–700;

(d): polyolefins or polyolefin copolymers having an acid value of 0.5–80 and a melt viscosity of 50–20,000 mpa·s at 200° C.;

(e): polymers obtained by crosslinking carboxyl group-containing vinyl polymers with an amine;

(f): vinyl polymers having at least 0.005% by weight of a crosslinking monomer based on a total monomer; and (g): silicone copolymers, silicone rubber or silicone-modified resins.

The present invention also provides a liquid developer comprising a carrier liquid containing silicone oil, and toner particles dispersed in said carrier liquid and each containing a coloring agent and a resin, said toner particles having such a particle size distribution on weight basis that provides two peaks in a particle diameter range of 0.01 μm or more but less than 10 μm and a particle diameter range of 10 μm or more but 100 μm or less, with a ratio of the area of the small particle diameter side peak to the area of the greater particle diameter side peak being 50:50 to 95:5.

A The present invention further provides an image forming method comprising contacting an electrostatic latent image-bearing surface with a thin layer of a liquid developer to develop said electrostatic latent image, wherein said liquid developer is as recited in any one of the above-described.

BRIEF DESCRIPTION OF THE DRAWINGS

Other objects, features and advantages of the present invention will become apparent from the detailed description of the preferred embodiments which follow, when considered in light of the accompanying drawings in which.

DETAILED DESCRIPTION OF THE PREFERRED EMBODIMENTS OF THE INVENTION

Figure 1:
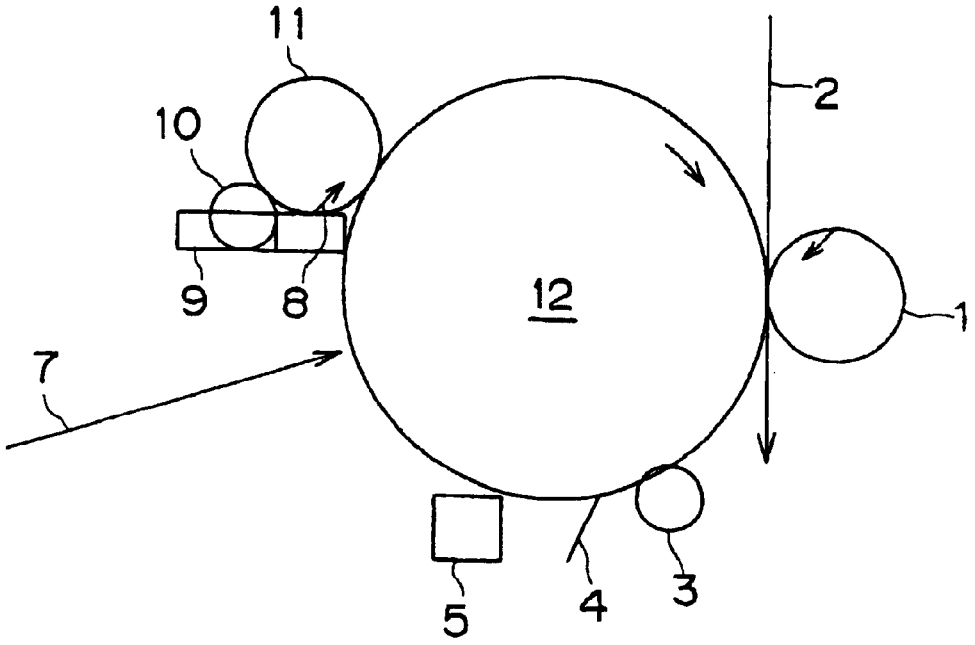
FIGS. 1–4 are schematic views showing image forming devices for carrying out the image forming method of the present invention.

Any known silicone oil may be used as a carrier liquid of the liquid developer of the present invention. Illustrative of suitable silicone oils are KF96 1–10000 cst (Shinetsu Silicone), SH200, SH344 (Toray Silicone) and TSF451 (Toshiba Silicone). Other silicone oils such as decamethyltetrasiloxane and octamethyltrisiloxane may also be used.

The carrier liquid may contain a fluorine-containing oil such as a fluorinated hydrocarbon, a fluorinated halogenated hydrocarbon or a fluorine-containing ether, e.g. $C_nF_m$, $C_nF_mO$, $C_nH_xF_m$, $C_nH_xCl_yF_m$ or $C_nH_xBr_yF_m$.

The carrier liquid may contain, if necessary, a vegetable oil, such as soybean oil, cottonseed oil, safflower oil, sunflower seed oil, Tsubaki oil, rape seed oil, canola oil, castor oil, linseed oil or olive oil (or its alkali refined, modified, thermally treated product), an aliphatic hydrocarbon (tradename Isopar H, G, L, M, V manufactured by Exxon Chemical Co., Ltd.), isododecane, n-hexane, isobutyl myristate or liquid paraffin such as Crystol 52, 72, 102, 172 6r 352 manufactured by Esso Petrochemical Inc.

The liquid developer according to the first aspect of the present invention comprises toner particles made of a coloring agent and a binder resin, a carrier liquid containing a silicone oil and an erucamide compound. The erucamide compound is preferably present in an amount of 0.01–10 parts by weight, more preferably 0.1–5 parts by weight, per 100 parts by weight of the liquid developer.

The erucamide compound in the liquid developer may be adsorbed on the toner particles or dissolved in the dispersing medium (carrier liquid) and can serve as a peeling agent and exhibit anti-blocking characteristics for a metallic heat fixation roller, so that the toner is prevented from depositing on the fixation roller. The erucamide compound is also effective in improving the developing and transferring characteristics.

The liquid developer according to the second aspect of the present invention comprises a carrier liquid containing silicone oil, and toner particles dispersed in the carrier liquid and each containing a coloring agent and a resin (binder resin), said resin contains at least one member selected from the group consisting of the above resins (a)–(g). These resins will be next described.

(a) Rosin Polymer Having a Softening Point of 50–190° C., a Glass Transition Point of 10–170° C. and a Molecular Weight of 2,000–40,000 and Obtained by Reacting (a1) a rosin glycidyl ester, (a2) dicarboxylic acid or dicarboxylic anhydride, (a3) at least one crosslinking agent selected from the group consisting of polyfunctional epoxy compounds, tri- or more polybasic acids or anhydrides thereof tri- or more polyhydric alcohols, and (a4) a dihydric alcohol:

The rosin glycidyl ester (a1) used in the present invention may be prepared by reacting with heating a rosin with epihalohydrin in the presence of an alkali substance such as an organic amine.

The rosin may be a naturally occurring rosin such as gum rosin, wood rosin, tall oil rosin or a modified product thereof such as hydrogenated rosin or disproportionated rosin. Abietic acid, dehydroabietic acid, dihydroabietic acid, dihydroabietic acid, pimaric acid or isopimaric acid which are organic components constituting a rosin may be of course used.

The organic amine is preferably a tertiary amine or an onium salt thereof. Examples of the tertiary amines include triethylamine, dimethylbenzylamine, methyldibenzylamine, tribenzylamine, dimethylaniline, dimethylcyclohexylamine, methyldicyclohexylamine, tripropylamine, tributylamine, N-phenylmorpholine, N-methylpiperidine and pyridine.

Examples of onium salts of tertiary amines include tetramethylammonium chloride, tetramethylammonium bromide, benzyltriethylammonium chloride, alyltriethylammonium bromide, tetrabutylammonium chloride, methyltrioctylammonium chloride, trimethylamine hydrochloric acid salt, triethylamine hydrochlorid acid salt and pyridine hydrochloric acid salt.

The dicarboxylic acid or dicarboxylic anhydride (a2) (hereinafter referred to simply as dicarboxylic acids) may be, for example, orthophthalic acid, isophthalic acid, terphthalic acid, endomethylenetetrahydrophthalic acid, tetrahydrophthalic acid, methyltetrahydrophthalic acid, hexahydrophthalic acid, methylhexahydrophthalic acid, maleic aciod, fumaric acid, succinic acid, adipic acid, azelaic acid, sebacic acid, $C_{8-10}$-alkenylsuccinic acid, $C_{6-18}$-alkylsuccinic acid and acid anhydrides thereof.

Polyfunctional epoxy compound used as a crosslinking agent(a3) may be, for example, an epoxy resin obtained from bisphenol A and an epihalohydrin, or a rosin epoxide or a rosin triepoxide obtained by reacting acrylated rosin or fumarated rosin with an epihalohydrin. The rosin of the rosin polyepoxide may be those used for the above-described rosin glycidyl esters.

Tri- or more polybasic acid or anhydride thereof used as a crosslinking agent (a3) may be, for example, trimellitic acid, pyromellitic acid or an anhydride thereof.

Tri- or more polyhydric alcohols used as a crosslinking agent (a3) may be, for example, glycerin, trimethylolethane, trimethylolpropane or pentaerythritol.

Dihydric alcohol (a4) is used for controlling the glass transition point of the rosin polymer and to improve the low temperature fixation. Any dihydric alcohol such as ethylene glycol, diethylene glycol trimethylene glycol, propylene glycol, 1,2-butanediol, 1,3-butanediol, 1,4-butanediol, bisphenol, hydrogenated bisphenol A, ethoxylated bisphenol A, propoxylated bisphenol A or bishydroxyethylterephthalate, may be used. The amount of the dihydric alcohol is suitably determined in view of the glass transition point of the rosin polymer product and is generally such that 1–70 mole % of the rosin glycidyl ester is substituted by the dihydric alcohol.

The rosin polymer (a) may be produced by, for example, a method in which (a1)–(a4) are simulatenously charged and reacted with heating, if necessary, in the presence of the organic amine as a catalyst or a method in which (a1), (a2) and (a4) are first reacted with heating, if necessary, in the presence of the organic amine as a catalyst, with the crosslinking agent (a3) being added, during the course of or after the termination of the reaction, to proceed with the reaction with heating.

It is preferred that the molar ratio of the rosin glycidyl ester to the dicarboxylic acids be 1:1, though a ratio of 1.5:1.0 to 1.0:1.5 is also usable. It is desired that the amount of the crosslinking agent be suitably prudently determined, since it has a great influence upon the characteristics of the binder resin for the toner, such as molecular weight and molecular weight distribution.

The amount of the polyfunctional epoxy compound being one of the above-described crosslinking agent may be determined in view of the functional number thereof, i.e. epoxy equivalent thereof and is generally 0.005–0.07 mole, preferably 0.050–0.04 mole, in the case of a fumarated rosin triglycidyl ester and is 0.005–0.14 mole, preferably 0.005–0.7 mole, in the case of a commercially available bisphenol A epoxy resin, each per 1 mole of the total of the rosin glycidyl ester and dicarboxylic acids.

The amount of the crosslinking agent of a polybasic carboxylic acid or a polyhydric alcohol is also determined in view of the functional number thereof and is, for example, 0.005–0.3 mole, preferably 0.005–0.15 mole, in the case of tribasic or trihydric per 1 mole of the total of the rosin glycidyl ester and dicarboxylic acids. The organic amine is not always necessary. However, the amine may be used to reduce the reaction time depending upon the kind of the dicarboxylic acid used. The amount of the amine is generally 0.01–5% by weight, preferably 0.05–1% by weight, based on the rosin glycidyl ester.

(b) Vinyl Polymer Having a Ratio Mw/Mn of the Weight Average Molecular Weight (Mw) to the Number Average Molecular Weight (Mn) of Greater than 4:

It is preferred that a vinyl polymer having a ratio Mw/Mn of greater than 10 and Mw of at least 100,000 as a toner resin for reasons of obtaining a toner with good fixation characteristics.

It is also preferred that the vinyl polymer be slightly crosslinked by reaction with a decomposable metal compound, because the molecular weight distribution becomes so wide that the toner can possess offset resistance while maintaining the minimum fixation temperature at a low level.

The decomposable metal compound may be a metal ion-containing compound. Illustrative of suitable monovalent metal ions are $Na^+$, $Li^+$, $Ag^+$, $Hg^+$ and $Cu^+$, illustrative of suitable divalent metal ions are $Ba^{2+}$, $Ba^{2+}$, $Ca^{2+}$, $Hg^{2+}$, $Sr^{2+}$, $Pb^{2+}$, $Fe^{2+}$, $Co^{2+}$, $Ni^{2+}$ and $Zn^{2+}$, and illustrative of suitable trivalent metal ions are $Al^{3+}$, $Se^{3+}$, $Fe^{3+}$, $Co^{3+}$, $Ni^{3+}$, $Cr^{3+}$ and $Y^{3+}$. Among the above metal ion compounds, more highly decomposable compounds can give better effect.

Vinyl polymers to be reacted with the decomposable metal compound may be vinyl polymers containing carboxyl group, carbonyl group, ether group, thioether group, amino group or amide group. Above all, the use of carboxyl group-containing vinyl polymer is preferred for reasons of the highest reactivity.

The carboxyl group-containing vinyl polymer may be produced from a carboxyl group-containing monomer and a monomer copolymerizable therewith. Examples of the carboxyl group-containing monomers include acrylic acid or α- or β-alkyl derivatives thereof such as acrylic acid, methacrylic acid, α-ethylacrylic acid and crotonic acid; and unsaturated dicarboxylic acids or monoester derivatives thereof such as fumaric acid, maleic acid and citraconic acid. Examples of the copolymerizable monomers include derivatives of monocarboxylic acid having a double bond; diester derivatives of dicarboxylic acids having a double bond, such as dibutyl maleate and dimethyl maleate; vinyl esters such as vinyl chloride, vinyl acetate and vinyl benzoate; ethylenic olefins such as ethylene, propylene and butylene; vinyl ketones such as viny methyl ketone and vinyl hexyl ketone; vinyl ethers such as vinyl methyl ether, vinyl ethyl ether and vinyl isobutyl ether; aromatic divinyl compounds such as vinyl benzene and divinyl naphthalene; carboxylic acid ester having two double bonds such as ethylene glycol diacrylate, ethylene glycol dimethacrylate and 1,3-butanedimethyl dimethacrylate; and divinyl compounds and compounds having 3 or more vinyl groups such as divinyl aniline, diinyl ether, divinyl sulfide and divinyl sulfone.

(c) Olefin Resin Having a Melt Index of 2.5–700:

The melt index here is a value as measured at 160±0.4° C. with an applied load of 2160 g±10 g.

A high molecular weight polyolefin resin having a relatively high melt viscosity and a melt index of 2.5–700 permits kneading at a high temperature with a colorant such as an organic pigment or carbon black. As a result, the colorant can be dispersed into primary particles so that the toner particles thus obtained give an image having a high image density and resolution and also exhibit good fixation characteristics.

The olefin resin having a melt index of 2.5–700 may be a resin containing polar groups such as carboxyl group, hydroxyl group, glycidyl group or amino group in the polymer chain thereof or a resin which is imparted with a partial crosslinking structure by a crosslinking agent or a radical initiator. For example, the olefin resin having a melt index of 2.5–700 may be obtained by copolymerizing polyolefin with a monomer having a polar group, by crosslinking the polymer with a crosslinkable monomer, or by combination of these.

The olefin resin having a melt index of 2.5–700 does not rapidly shows thermoplasticity during a fixation step and, thus, is scarcely melt-adhered to a fixation roller. Because of its high molecular weight, the resin shows good fixation after cooling. When the melt index is less than 2.5, the fluidity of the toner when heated becomes poor. Too large a melt index in excess of 700, on the other hand, causes excessive fluidity so that the sharpness becomes poor and melt-adhesion onto the heat roller is apt to be caused.

The olefin resin having a melt index of 2.5–700 is generally used in an amount of 0.1–20 parts by weight, preferably 1–10 parts by weight, per 1 part by weight of the colorant.

Illustrative of suitable olefin resin having a melt index of 2.5–700 are as follows. Parenthesized is weight ratio.

(1) ethylene-vinyl acetate-lauryl methacrylate copolymer (60/30/10); ethylene-vinyl acetate-methyl methacrylate-dimethylaminoethyl methacrylate copolymer (50/30/10/10)

(3) ethylene-vinyl acetate-ethyl acrylate-divinylbenzene copolymer (50/20/20/10); ethylene-ethyl acrylate-phthalic anhydride copolymer (96/2/2); propylene-vinyl acetate-lauryl methacrylate copolymer (60/30/10).

These olefin resins having a melt index of 2.5–700 are commercially available under the trade name of, for example, Evaflex A-701, A-702, A-703 and N-410 (manufactured by Mitsui Polychemical Inc.).

(d) Polyolefin or Polyolefin Copolymer Having an Acid Value of 0.5–80 and a Melt Viscosity of 50–20,000 mPa·s at 200° C.:

When the acid value of a polyolefin or a polyolefin copolymer is less than 0.5, specific charge (Q/M) of the toner is lowered so that the transferability of the toner to a fixation support (transfer paper) becomes poor. When the acid value exceeds 80, on the other hand, preservability of the toner becomes poor. Thus, during storage at a high temperature, solidification of the toner may occur. When the melt viscosity is less than 50 mPa·s at 200° C., a toner layer penetrates to the rear side of the transfer paper and the duplex copy becomes illegible. When the melt viscosity exceeds 200 mpa·s at 200° C., the toner is not easily fuse-bonded during the fixation so that low temperature fixation cannot be carried out. Shown below are polyolefins that meet with the above conditions. Parenthesized are weight ratios.

TABLE 1

| No. | Polyolefin or polyolefin copolymer | Viscosity at 200° C. (mPa · s) | Acid Value |
|---|---|---|---|
| 1 | Ethylene-vinylpyridine-maleic acid copolymer (90/5/5) | 520 | 26 |
| 2 | Ethylene-ethyl acrylate-acrylic acid copolymer (90/5/5) | 10000 | 23 |
| 3 | Polyethylene oxide | 360 | 18 |
| 4 | Polypropylene oxide | 470 | 18 |
| 5 | Ethylene-methacrylic acid copolymer (95/5) | 12300 | 26 |
| 6 | Propylene-maleic anhydride copolymer | 580 | 5.8 |
| 7 | Propylene-butyl acrylate-itaconic acid copolymer (85/13/2) | 1200 | 12 |

Polymer Obtained by Crosslinking Carboxyl Group-Containing Vinyl Polymer with an Amine:

The carboxyl group-containing vinyl polymer may be produced from a carboxyl group-containing monomer and a monomer copolymerizable therewith. Examples of the carboxyl group-containing monomers include acrylic acid or α- or β-alkyl derivatives thereof such as acrylic acid, methacrylic acid, α-ethylacrylic acid and crotonic acid; and unsaturated dicarboxylic acids or monoester derivatives thereof such as fumaric acid, maleic acid and citraconic acid. Examples of the monomers copolymerizable with the carboxyl group-containing monomer include derivatives of monocarboxylic acid having a double bond, such as styrene, α-methylstyrene, P-chlorostyrene, vinylnaphthalene, methyl acrylate, ethyl acrylate, butyl acrylate, dodecyl acrylate, octyl acrylate, phenyl acrylate, methyl methacrylate, ethyl methacrylate, butyl methacrylate, octyl methacrylate, acrylonitrile, methacrylonitrile and acrylaminde; diester derivatives of dicarboxylic acids having a double bond, such as dibutyl maleate and dimethyl maleate; vinyls such as vinyl chloride, vinyl acetate and vinyl benzoate; ethylenic olefins such as ethylene, propylene and butylene; vinyl ketones such as viny methyl ketone and vinyl hexyl ketone;

vinyl ethers such as vinyl methyl ether, vinyl ethyl ether and vinyl isobutyl ether; aromatic divinyl compounds such as vinyl benzene and divinyl naphthalene; carboxylic acid ester having two double bonds such as ethylene glycol diacrylate, ethylene glycol dimethacrylate and 1,3-butanedimethyl dimethacrylate; and divinyl compounds and compounds having 3 or more vinyl groups such as divinyl aniline, diinyl ether, divinyl sulfide and divinyl sulfone. These compounds may be used singly or as a mixture.

Good results are obtained when the content of the carboxyl group-containing monomer contained in the carboxyl group-containing polymer is 0.1–30% by weight. Especially good results are obtained with a range of 0.5–20% by weight.

The amine for crosslinking the carboxyl group-containing polymer is preferably a compound of the following formula:

$$[(CH_2)_aO]_xHRN$$

$$[(CH_2)_bO]_yH$$

wherein a and b are each an integer of 2–4 and may be the same or different, x and y are each an integer of 1–50 and may be the same or different, and R stands for an alkyl group (inclusive of branched and cycloalkyl) having 8–30 carbon atoms.

The amine is used in an amount of about.0.1–0.5 part by weight per 100 parts by weight of the polymer.

(f) Vinyl Polymer Having At Least 0.005% by Weight of a Crosslinking Monomer Based on a Total Monomer:

A suitable vinyl monomer for obtaining the vinyl polymers may be a styrene monomer such as styrene, o-methylstyrene, m-methylstyrene, p-methylstyrene, α-methylstyrene, p-ethylstyrene, 2,4-dimethylstyrene, p-n-butylstyrene, p-tert-butylstyrene, p-n-hexylstyrene, p-n-octylstyrene, p-n-nonylstyrene, p-n-decylstyrene, p-n-dodecylstyrene, p-methoxystyrene, p-phenylstyrene, p-chlorostyrene or 3,4-dichlorostyrene.

Examples of other vinyl monomers include ethylenically unsatrurated monoolefins such as ethylene, propylene, butylene and isobutylene; haloganated vinyls such as vinyl chloride, vinylidene chloride, vinyl bromide and vinyl fluoride; vinyl esters such as vinyl acetate, vinyl propionate, vinyl benzoate and vinyl butyrate; α-methylene aliphatic monocarboxylic acid esters such as methyl acrylate, ethyl acrylate, n-butyl acrylate, isobutyl acrylate, propyl acrylate, n-octyl acrylate, dodecyl acrylate, lauryl acrylate, 2-ethylhexyl acrylate, stearyl acrylate, 2-kethyl acrylate, phenyl acrylate, methyl α-chloroacrylate, methyl methacrylate, n-butyl methacrylate, isobutyl methacrylate, n-octyl methacrylate, dodecyl methacrylate, lauryl methacrylate, 2-ethylhexyl methacrylate, stearyl methacrylate, phenyl methacrylate and dimethylaminoethyl methacrylate; acrylic or methacrylic acid and derivatives thereof such as acrylonitrile, methacrylonitrile and acrylamide; vinyl ethers such as vinyl methyl ether, vinyl ethyl ether and vinyl isobutyl ether; vinyl ketones such as vinyl methyl ketone, vinyl hexyl ketone and methyl isopropenyl ketone; N-vinyl compounds such as N-vinylpyrrole, N-vinylcarbazole, N-vinylindole and N-vinylpyrrolidone; and vinyl naphthalenes. These monomers may be used singly or in a combination of a plurality thereof. Also, the above monomers may be so combined as to give a copolymer by polymerization.

The crosslinking agent monomer used in conjunction with the above monomer is a compound having two or more polymerizable double bonds. Examples thereof include aromatic divinyl compounds such as divinylbenzene, divinylnaphthalene and derivatives thereof; diethylene-type carboxylic acid esters such as diethylene glycol acrylate, diethylene glycol methacrylate, triethylene glycol methacrylate, trimethylolpropane triacrylate, acryl methacrylate, t-butylaminoethyl methacrylate, tetramethylene glycol dimethacrylate, 1,3-butanediol dimethacrylate, ethylene glycol dimethacrylate and tetramethylolmethane tetraacrylate; all divinyl compounds such as N,N-divinylaniline, divinyl ether, divinyl sulfide and divinyl sulfone; and compounds having three or more vinyl acids. These compounds may be used singly or as a mixture. The crosslinking agent monomer is used in an amount of at least 0.005% by weight, generally not more than 20% by weight, preferably in the range of 0.1–5% by weight, based on the total monomers. An amount of the crosslinking agent monomer below 0.005% by weight fails to increase the molecular weight of the polymer and the toner will cause offset at a low temperature. With an increase of the amount, the minimum fixation temperature increases. An amount of 20% by weight is not an upper limit. The amount may be above 20% by weight when a chain transfer agent is used.

(g) Silicone Copolymer, Silicone Rubber or Silicone-Modified Resin:

The silicone copolymer, silicone rubber or silicone-modified resin when incorporated into a toner can improve dispersibility, fixation properties and hot offsetting properties.

As the silicone copolymer, there may be used a product, such as a silicone acrylate copolymer, obtained by subjecting a reactive silicone compound and a polymierizable vinyl monomer to copolymerization or graft polymerization in the presence of a polymerization initiator in a solvent such as a silicone oil, a higher fatty acid ester, an animal or vegetable oil, such as soybean oil, rape seed oil, fish oil, or a hydrocarbon.

As the reactive silicone compound, there may be mentioned FM1111, 1125, FM2231, 2242, FP2231, 2242, FM3325, FM4425, FM0711, FM0721 and FM0725 (products of Chisso Corporation) and X22-161A, X22-164C, X22-174DX and X22-5002 (products of Shinetsu Kagaku Co., Ltd.).

Examples of the polymerizable vinyl monomers include methacrylic acid esters, styrene, vinyltoluene, acrylic acid, methacrylic acid, itaconic acid, maleic acid, maleic anhydride, trimethylpropane triacrylate and divinylbenzene. For reasons of improved dispersibility and hot offset of the toner, the weight ratio of the reactive silicone to the polymerizable vinyl monomer is 5:95 to 95:5, preferably 30:70 to 70:30.

The colorant used for the purpose of the present invention may be an inorganic pigment such as PRINTEX V, PRINTEX U, PRINTEX G, SPECIAL BLACK 15, SPECIAL BLACK 4, SPECIAL BLACK 4-B (made by Degussa Co., Ltd.), MITSUBISHI #4, MITSUBISHI #30, MA-11, MA-100 (made by Mitsubishi Chemical Co., Ltd.), RABEN 1035, RABEN 1252, NEWSPECT (made by Columbia Carbon Ltd.), REGAL 400, REGAL 660, BLACKPEARLS 900, 1100,1300, MOGAL L (made by Cabot Co., Ltd.) or an organic pigment such as Phthalocyanine Blue, Phthalocyanine Green, Sky Blue, Rhodamine Lake, Malachite Green Lake, Methyl Violet Lake, Peacock Blue Lake, Naphthol Green B, Naphthol Green Y, Naphthol Yellow S. Naphthol Red, Lithol Fast Yellow 2G, Permanent Red 4R, Brilliant Fast Scarlet, Hansa Yellow, Benzidine Yellow, Lithol Red, Lake Red, Brilliant Carmine 6B, Permanent Red F5R, Pigment Scarlet 3B, Indigo, Thioindigo Oil Pink or Borduaux 10B.

In the present invention, these pigments may be previously coated with a resin, etc. for forming a toner. Any resin conventionally used in the production of liquid developers may be used as the coating resin. Typical examples thereof include polyolefins, acrylic resins, rosin-modified resins, styrene-butadiene resins, naturally occurring resins, olefin-acrylate copolymers and paraffin wax. These may be used singly or in a combination of two or more, or may be used in conjunction with other resins. Examples of paraffin wax and polyolefins are as follows.

As the coating treatment, a flushing method is especially effective for dispersing the pigment into its primary particles and for further improving the gradation, resolution and image density.

In the flushing method, a pigment or a pigment paste containing water is placed together with a resin solution or a resin in a kneader called a "flusher" and well mixed. In the course of this process, the water surrounding the pigment particles is substituted with the resin solution or the resin. Thereafter, the mixture is taken out from the kneader, and the water phase of the mixture is removed. The mixture containing the pigment kneaded and dispersed in the resin solution or resin with heating or at room temperature is dried to remove the solvent, and the resulting solid lump is grounded. The thus obtained product is referred to, in the present invention, as a "flushing colorant". In the above method, the water and the solvent may be removed under a reduced pressure during the kneading. Any resin conventionally used as a binder resin for wet-type toner may be used for the flushing. In the flushing treatment, a dye may give the same results as those afforded by the pigment when the dye is kneaded with water into a mud-like paste. Thus, the flushed dye may be used as a constituent of the toner. The amount of the pigment or dye to be flushed is preferably 10–60 parts by weight per 100 parts by weight of the resin. It is advantageous to carry out the flushing treatment in the presence of humic acid, a salt of humic acid (e.g. Na salt, $NH_4$ salt), or a derivative of humic acid. A suitable amount of the humic acid compound to be added to the mixture is about 0.1 to 30% by weight based on the dye-or pigment-containing aqueous liquid.

The toner for use in a liquid developer according to the above-described first aspect of the present invention may be obtained by performing the above flushing method in the presence of an erucamide compound. It is preferred that the erucamide compound be used in an amount of 0.01–10 parts by weight, preferably 0.1–5 parts by weight, per 100 parts by weight of the liquid developer finally formulated.

The toner for use in a liquid developer according to the above-described second aspect of the present invention may be obtained by kneading the coloring agent with the binder resin (a)–(g) using dual rolls, a kneader flusher, etc., followed by pulverization. In this case, in conjunction with the resin (a)–(g), the following resin may be used:

synthetic polyesters; polypropylene or modified polypropylene; natural waxes such as montan wax, candelilla wax, sugar cane wax, ocurie wax, beeswax, Japan wax and bran wax; natural resins such as ester gum and hardened rosin; natural-resin-modified cured resins such as natural resin-modified maleic acid resins, natural resin-modified phenol resins, natural resin-modified polyester resins, natural resin-modified pentaerythritol resins and epoxy resins. Specific examples of these resins are as follows:

Products of Eastman Chemical Inc.: N-10, N-11, N-12, N-14, N-34, N-45, C-10, C-13, C-15, C-16, E-10, E-11, E-12, E-14, E-15;

Products of Mitsui Petrochemical Inc.: 110P, 220P, 220MP, 820MP, 410MP, 210MP, 310MP, 405MP,. 200P, 4202E and 4053E; Products of Sanyo Kasei Co., Ltd.: 131P, 151P, 161P, 171P, E300 and E250P;

Products of Sazol Inc.: H1, H2, A1, A2, A3 and A4;

Products of BASF Inc.: OA, WAX, A WAX;

Products of Petrolite Inc.: BARECO 500, BARECO 2000, E-730, E-2018, E-2020, E-1040, PETRONABA C, PETRONABA C-36, PETRONABA C-400 and PETRONABA C-7500;

Products of Hoechst Inc.: PE580, PE130, PED121, PED136, PED153, PED521, PED522 and PED534;

Products of Union Carbide Inc.: DYN1, DYNF, DYNH, DYNJ, and DYNK;

Products of Monsant Inc.: ORUZON 805, 705 and 50;

Products of duPont Inc.: ALATHON 3, 10, 12, 14, 16, 20, 22 and 23;

Products of Allied Chemical Inc.: AC Polyethylene 6, 6A and 615;

Products of Mitsui Polychemical Inc.: EVAFLEX 150, 210, 220, 250, 260, 310, 360, 410, 420, 450, 460, 550 and 560

Suitable dispersing resins cojointly used for the purpose of the present invention include copolymers or graft copolymers of (A) at least one vinyl monomer represented by the formula $$CH_2{=}CR_1COOC_nH_{2n+1}$$

(wherein $R_1$ represents H or $CH_3$, and n is an integer of 6–20) with (B) at least one monomer selected from a vinyl monomer of the formula $$CH_2{=}CR_1COOR_2$$

(wherein $R_1$ represents H or $CH_3$ and $R_2$ represents H, $C_nH_{2n+1}$ (n=1 to 5), $C_2H_4OH$ or $C_2H_4NC_mH_{2m+1}$ [m=1 to 4]), vinylpyridine, vinylpyrrolidone, ethylene glycol dimethacrylate, styrene, divinylbenzene and vinyltoluene.

For the purpose of improving dispersibility of the toner particles in the silicone oil carrier liquid, an acroyl group-containing silicone material such as LS4080 of Shinetsu Silicone Co., Ltd. may be copolymerized. There may also be used AK-5 of Toa Gosei Kagaku Co., Ltd. or TM0701, FM0711, FM0721 or FM0725 of Chisso Ltd.

The above-described coloring agent, resin, carrier liquid are placed in a dispersing device such as ball mill, keddy mill, disk mill or pin mill, dispersed and kneaded to obtain a concentrate of toner. A liquid developer may be obtained by dispersing the concentrate in a carrier liquid.

The liquid developer is formed into a thin layer on a roller or a belt. By contacting the thin layer with an electrostatic latent image-bearing surface, an image having a high density and a high resolution may be developed. The thin layer suitably has a thickness of 1–15 $\mu$m, desirably 3–10 $\mu$m. Too small a thickness below 1 $\mu$m is insufficient to obtain satisfactory density. Too large a thickness in excess of 15 $\mu$m will cause reduction of resolution.

When development of an electrostatic latent image is carried out after the thin layer of the liquid developer formed on the roller or belt has been subjected to corona discharge, the cohesion of the toner is improved and, hence, the resolution may be improved. The corona discharge of the same polarity as that of the toner gives better results. The voltage is suitably 500–800 V.

When development of an electrostatic latent image is carried out after a pre-wetting liquid such as a carrier liquid has been deposited thereon, the transfer efficiency is improved and, hence, high quality image can be obtained. The thickness of the pre-wetting liquid layer is 0.1–5 $\mu$m. preferably 0.3–1 $\mu$m. Too small a thickness below 0.1 $\mu$m is insufficient to obtain an improvement. Too large a thickness in excess of 5 μm will cause reduction of resolution.

When the toner image obtained by developing an electrostatic latent image is transferred to an intermediate transfer medium and the transferred image is transferred to a transfer medium, the secondary transfer can be carried out with an applied pressure so that high quality images can be obtained even when paper is used as the transfer medium. The intermediate transfer medium may preferably has a surface made of a material having solvent resistance and being elastic in nature, such as urethane rubber, nitrile rubber, hidrin rubber or urethane-fluoroplastic copolymer. It is further preferred that the surface be coated with a fluoroplastic.

When the surface of a photoconductor on which an electrostatic latent image is to be formed has water and oil repellency (contact angle θ is 30° or more), the transfer efficiency and cleaning properties are improved and, hence, high quality images may be obtained. Increase of water repellency and oil repellency may be achieved by coating a fluoroplastic-containing block copolymer such as Modiper F200 or 210 of Nippon Yushi Co., Ltd. The contact angle herein is measured with Model CA-W automatic contact angle meter manufactured by Kyowa Kaimen Kagaku Co., Ltd. using, as a solvent, ion exchanged water for water repellency and isododecane for oil repellency.

In a further aspect of the present invention, toner particles each containing a coloring agent and a resin and having such a particle size distribution on weight basis that provides two peaks in a particle diameter range of 0.01 μm or more but less than 10 μm and a particle diameter range of 10 μm or more but 100 μm or less (namely, two peaks are present in a particle size distribution plotted with the particle diameter as abscissa and the weight as ordinate) with a ratio of the area of the small particle diameter side peak to the area of the greater particle diameter side peak being 50:50 to 95:5.

The liquid developer using the toner having such a particle size distribution gives an image having good dot image reproducibility, good gradation, high image density, high resolution and good fixation property and good semi-gloss property. The ratio of the area of the small particle diameter (0.01–10 μm) side peak (small diameter toner) to the area of the greater particle diameter (10–100 μm) side peak (large diameter toner) is preferably 70:30 to 90:10. When the ratio is below 50:50, image density, solid pattern uniformity, gradation and resolution are not good. When the ratio is above 95:5, there are caused problems in dot image reproducibility, background stains by filming, semi-gloss property and formation of voids in flush fixation.

A large diameter toner may be obtained by dispersing or coating a metal or metal oxide (e.g. Fe. Cu, Ni, $Fe_2O_3$, $SiO_2$, TiO, ZnO), a dye, a pigment, carbon, etc. with a resin (such as a vinyl chloride resin, a styrene resin, an acrylic resin, a phenol resin or a rosin-modified resin), wax (such as carbauna was, bees wax, paraffin wax or rice wax), a polyester resin, a pteroleum resin, butadiene resin, fluoroplastic, a polyolefin resin, an acrylic resin, a silicone resin or silicone rubber. Resin particles may be used. An additive such as a polarity controlling agent or a dispersing agent may be suitably added and kneaded.

The large particle diameter toner or coarse particles serve to improve transferability and sharpness and to prevent toner filming on the photosensitive material or intermediate transfer medium. When the large diameter toner contains a resin or substance having a softening point higher than that of the small diameter toner, the effect of the present invention is enhanced. In particular, the large particle size toner has a softening point of at least 80° C., preferably 100–150° C., while the small particle size toner has a softening point of (–) 30° C. or more, preferably (–)20 to 120° C. The particle diameter of the large particle size toner is measured by LDSA 2300A manufactured by Tonichi Application Inc., while the particle diameter of the small particle size toner is measured by Particle Size Analyzer ZA-CP-3 manufactured by Shimadzu Inc. The use of disazo yellow pigment, carmine pigment, quinacridone pigment, cyan or phthalocyanine pigment is preferred for reasons of freedom of reduction of image density, deterioration of resolution and background stains.

In a further aspect of the present invention, there is provided a toner for electrophotography, which comprises substantially spherical crosslinked polymer gel particles containing a liquid, and a coloring agent contained in each of the gel particles.

Such a toner is a paste having extremely low viscosity and having such a fluidity as a non-liquid and non-powder developer. Thus, there is no need for taking care of scattering of powder or liquid.

The gel particles generally have an average particle diameter of 0.5–5 μm. For reasons of compatibility with requirement for high resolution or sharpness in electrophotography and of easiness of obtaining high image quality, the average particle diameter is preferably 2–3 μm.

The liquid content of the gel particles is 10–90% by weight, preferably 30–85% by weight, more preferably 40–80% by weight. The gel particles suitably contain a resin, a wax, a charge controlling agent, etc. When the gel particles contain a resin or a wax, it is preferred that the softening point thereof is 100° C. or less. During fixation on a recording medium such as paper or an OHP film, the wax is melted to improve the adhesion to the recording medium, namely to improve fixation property.

The gel particles may be prepared by crosslinking a polymer having a size sufficient to be dissolved in a liquid by itself or with the use of a suitable crosslinkable polyfunctional monomer or polymer. The gel particles may also be obtained by polymerizing the main polymer in the presence of a polyfunctional monomer.

The liquid may be a polar liquid such as water. A petroleum-type non-polar liquid may also be used. From the standpoint of safety, the use of water is preferred.

The crosslinking may be effected by irradiation of actinic light such as electron beam or ultraviolet rays or by addition of a radial initiator together with heating or applying radiating energy.

The particle size distribution may be controlled by the conventional manner such as by adjusting the concentration of the polymer or mixing ratio of the crosslinking agent in a solution which is to be subjected to the crosslinking.

Specific examples of the monomers are given below.

[Examples of Monomers]

As the monomer, there may be used a styrene compound such as styrene, o-methylstyrene, m-methylstyrene, p-methylstyrene, α-methylstyrene, p-ethylstyrene or sodium p-styrenesulfonate; an acrylic acid ester such as methyl acrylate, ethyl acryolate, n-propyl acrylate, n-butyl acrylate, 2-ethylehexyl acrylate or glydicyl acrylate; a methacrylic acid ester such as methyl methacrylate, ethyl methacrylate, n-propyl methacrylate, n-butyl methacrylate or 2-ethylhexyl methacrylate; N-substituted acrylamide compound such as acrylonitrile, acrylamide, N-isopropylacrylamide, N-piperylacrylamide; or a crosslikable monomer such as divinylbenzene, methylenebisacrylamide, 1,3-butane diol dimethacrylate.

[Examples of Initiator]

As the initiator, there may be used a diazo compound such as 2,2'-azobisisobutyronitrile, 2,2'-azobis (2,4-dimethylavaleronitrile), 1,1'-azobis(cyclohexane-1-carbonitrile) or 2,2'-azobis-4-methoxy-2,4-dimethylvaleronitrile, or a peroxide such as benzoylperoxide or lauroylperoxide. The polymerization initiator is generally used in an amount of 0.1–10% by weight based on the monomer.

Specific examples of the polymers are: polyethylene oxide, polypropylene oxide, polyvinylidene fluoride, polyacrylonitrile, poly(meth)acrylic acid oligoethylene oxide, polyethyleneimine, polyalkylene sulfide, polyphosphazene or polysiloxane having oligoethylene oxide side chain, or polymers containing ionic groups such as naphion or flemion.

The use of a composition having high ion conductivity when gelled is particularly preferred.

The resin, wax, etc. contained in the gel particles may be used for flushing treatment of the colorant such as a pigment. The flushing treatment can reform the surfaces of the colorant, can permit ionic components of the gel to adsorb on the surfaces of the pigment particles and can prevent the elution of impurities such as undesirable ions. There is also obtained an effect that the dispersion of the colorant is improved so that the coloring power of the toner is improved. Details of the flushing treatment are as previously described.

Next, an image forming process according to the image forming method of the present invention will be described.

Referring to FIG. 1, designated as 12 is a photoconductor (such as organic photosemconductor, selenium or amorphous silicone) rotating in the direction of the arrow and charged by a corona discharger 5 and as 7 is an exposing section for writing. A developing roller 11 is supplied and applied uniformly with a developer from a developer container 9 by a roller 10. The developer layer thus formed on the developing roller 11 is optionally impressed with a voltage by a corona discharger 8 and develops a latent image on the photoconductor. Each of the rollers may be made of a metal, rubber, plastic or sponge and may be a grooved roll such as a wire bar or a gravure roller.

The toner image thus formed on the photoconductor 12 is transferred to a transfer medium 2 by a transfer roller 1. The transfer is by pressure, corona discharge, heat, a combination of heat and pressure, a combination of corona and pressure or a combination of corona and heat, so that an image is formed on the transfer medium.

Residual toner on the photoconductor is removed by cleaning roller 3 and a cleaning blade 4 to be ready for the next image formation.

Figure 2:
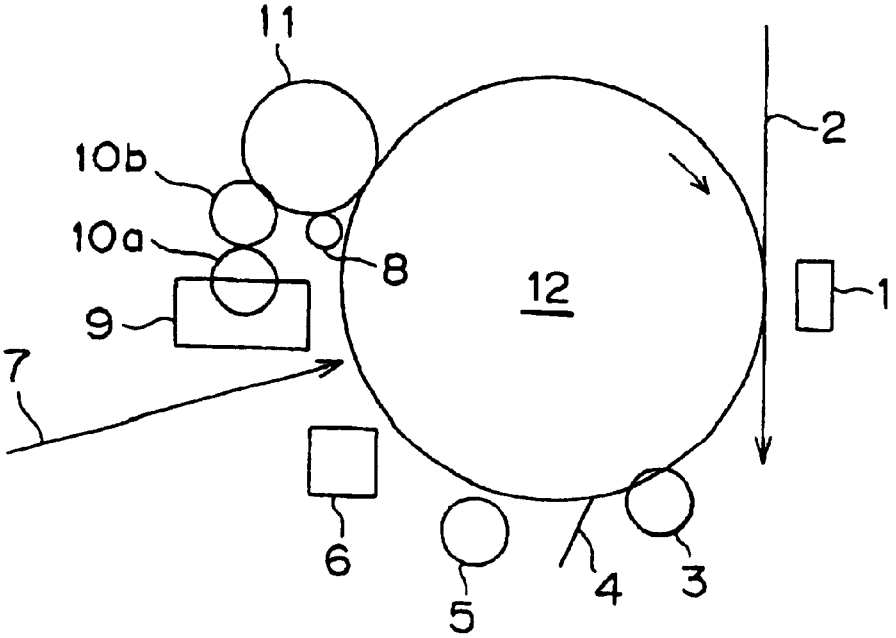

FIG. 2 differs from FIG. 1 in that the former has a roller 6 for pre-wetting with a carrier liquid. The developer is applied from a developer container to a developer roller 11 through rollers 10*a* and 10*b*. The toner layer thus applied is impressed with a direct current voltage by a corona discharger 8. The developing roller 11 of FIG. 2 has a larger width of contact with a photoconductor as compared with that in the case of FIG. 1, so that the latent image is sufficiently developed. The toner image developed on the photoconductor is transferred to a transfer medium 2 by a corona discharger 1 to form an image thereon.

Figure 3:
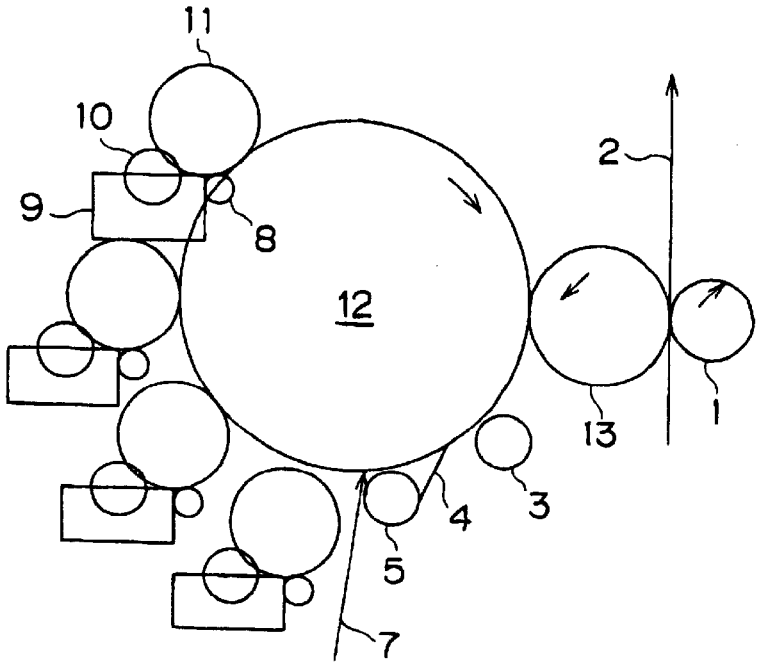

FIG. 3 illustrates an embodiment for a developing system for generating color copies. Developer containers 9 for respective yellow, magenta, cyan and black toners are disposed on a photoconductor. A latent image on the photosensitive member 12 is developed with each of the toners and the developed image is transferred to an intermediate transfer medium 13. Thereafter, the image is transferred to a transfer medium using a transfer roller 1 by pressure, corona, heat, etc.

Figure 4:
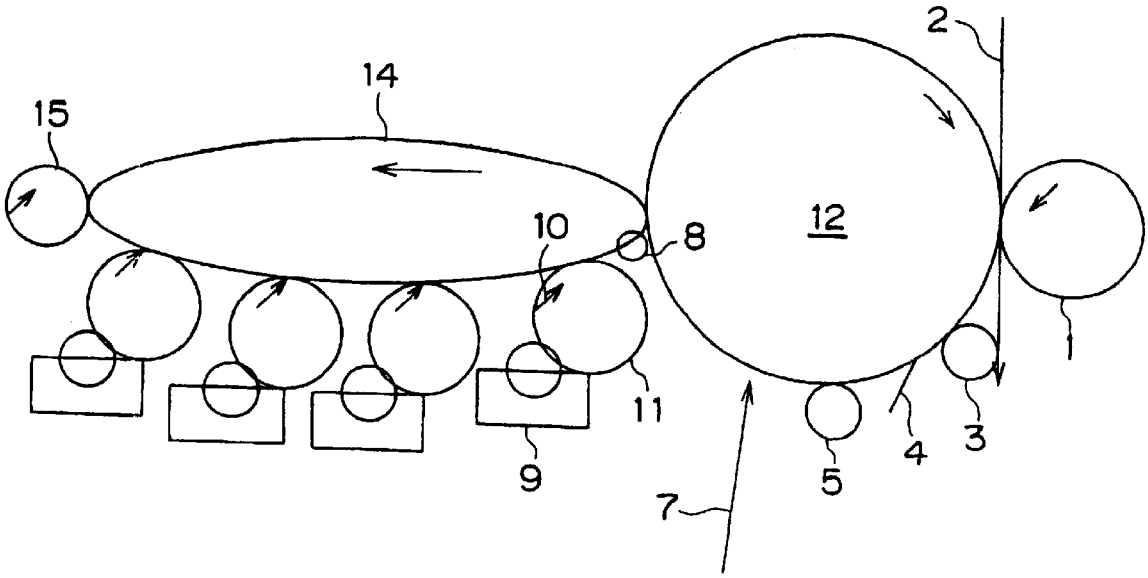

FIG. 4 illustrates an image forming process for color copy. Similar to FIG. 3, developer containers 9 for respective yellow, magenta, cyan and black toners are disposed. A layer of the developer is applied to a belt 14 and develops a latent image on a photoconductor 12. The developed image is transferred to a transfer medium 2. The belt 14 for applying the developer layer is cleaned by a cleaning roller 15 and a cleaning blade.

EXAMPLES

The following examples and comparative examples will further illustrate the present invention. Parts are all by weight.

Preparation of Colorant by Flushing Method

Preparation Example C1

20 g of ammonium humate was dissolved in 200 g of water in a gallon kneader, to which 250 g of carbon black (Mitsubishi #44) was added and thoroughly mixed and dispersed in the kneader. Thereafter, 750 g of Epolen E-15 (manufactured by Kodak Inc.) and 500 g of erucamide were added and mixed at a temperature of about 100° C. Water was then removed from the mixture. The resulting mixture was further kneaded at about 120° C. for 4 hours, and then subjected to vacuum drying, cooling and pulverization to obtain Colorant C1.

Preparation Example C2

10 g of sodium humate was dissolved in 200 g of water in a gallon kneader, to which 250 g of carbon black (Mogal A manufactured by Columbia Carbon Inc.) was added and thoroughly mixed and dispersed in the kneader. Thereafter, 600 g of Sunwax 151P and 100 g of erucamide were added and kneaded at a temperature of about 150° C. The mixture was further kneaded for 2 hours at 120° C., and then subjected to vacuum drying, cooling and pulverization to obtain Colorant C2.

Preparation Example C2–C10

Colorant Preparation Example 1 was repeated in the same procedure as described using the following raw materials, thereby obtaining Colorants C314 C10.

| | |
|---|---|
| Colorant C3 | |
| Printex V | 300 parts |
| PED521 | 500 parts |
| Erucamide | 80 parts |
| Ammonium humate | 25 parts |
| Water | 150 parts |
| Colorant C4 | |
| Printex V | 300 parts |
| Sunwax 250P | 300 parts |
| Erucamide | 100 parts |
| Ammonium humate | 25 parts |
| Water | 150 parts |

-continued

| | |
|---|---|
| Colorant C5 | |
| Regal 400 | 300 parts |
| Bees wax | 500 parts |
| Erucamide | 500 parts |
| Ammonium humate | 25 parts |
| Water | 250 parts |
| Colorant C6 | |
| Regal 400 | 300 parts |
| Paraffin wax (64° C.) | 400 parts |
| Erucamide | 80 parts |
| Humic acid | 50 parts |
| Water | 250 parts |
| Colorant C7 | |
| Phthalocyanine Blue | 250 parts |
| Rosin-modified maleic acid resin | 400 parts |
| Erucamide | 100 parts |
| Humic acid | 50 parts |
| Water | 100 parts |
| Colorant C8 | |
| Phthalocyanine Green | 250 parts |
| Sunwax 171P | 280 parts |
| Erucamide | 300 parts |
| Humic acid | 50 parts |
| Water | 100 parts |
| Colorant C9 | |
| Thioindigo | 300 parts |
| Cyclic rubber | 300 parts |
| Erucamide | 100 parts |
| Water | 100 parts |
| Colorant C10 | |
| Printex G | 250 parts |
| Alkali Blue | 50 parts |
| Acrylic resin | 800 parts |
| Erucamide | 100 parts |
| Calcium humate | 5 parts |
| Water | 100 parts |

Preparation of Liquid Developer

Preparation Example 1

The following components were placed in a ball mill and dispersed for 24 hours:

| | |
|---|---|
| Colorant C1 obtained in Preparation Example C1 | 50 parts |
| 20% Solution of a copolymer of stearylmethacrylate/methyl methacrylate/methacrylic acid/ glycidyl methacrylate (80/10/5/5) in KF96 (manufactured by Shinetsu Silicon, viscosity: 10 cst) | 100 parts |
| KF96 (manufactured by Shinetsu Silicon, viscosity: 100 cst) | 200 parts |

The dispersion was further mixed with 300 parts of KF96 (manufactured by Shinetsu Silicon, viscosity: 100 cst) and then dispersed for 1 hour to obtain a concentrate toner. 200 Grams of the concentrate were diluted with KF96 (manufactured by Shinetsu Silicon, viscosity: 100 cst) to obtain Developer D1.

Preparation Example 2

Using the following components, Developer D2 was prepared in the same manner as Preparation Example 1:

| | |
|---|---|
| Colorant C2 obtained in Preparation Example C2 | 60 parts |
| 10% Solution of a copolymer of stearylmethacrylate/methyl methacrylate/methacrylic acid/ hydroxymethyl methacrylate (85/7/4/4) in KF96 (manufactured by Shinetsu Silicon, viscosity: 10 cst) | 200 parts |
| KF96 (manufactured by Shinetsu Silicon, viscosity: 100 cst) | 100 parts |

Preparation Example 3

Preparation Example 1 was repeated in the same manner as described except that Colorant C3 obtained in Preparation Example C3 was used as the colorant to obtain Developer D3.

Comparative Preparation Examples 1–3

Preparation Examples 1–3 were repeated in the same manner as described except that Isopar H was used as the diluent to obtain Comparative Developers 1–3.

Image Formation

Examples 1–3 and Comparative Examples 1–3

Image forming tests were carried out using a testing device composed of the apparatus shown in FIG. 1 and a heat roll fixing apparatus mounted thereon. The tests were performed in an oil-less mode using the Developers D1–D3 and Comparative Developers 1–3. The results were as summarized in Table 2. In this and succeeding examples, the image density was measured using X-Rite. Sharpness and Offset were evaluated by comparison with a sample according to the following ratings.

| | |
|---|---|
| Rank 5 | Very good |
| Rank 4 | Good |
| Rank 3 | Fair |
| Rank 2 | No good |
| Rank 1 | Very bad |

TABLE 2

| Example | 1 | 2 | 3 | | | |
|---|---|---|---|---|---|---|
| Comparative Example | | | | 1 | 2 | 3 |
| Developer | D1 | D2 | D3 | Comp. 1 | Comp. 2 | Comp. 3 |
| Image Density | 1.48 | 1.40 | 1.46 | 1.41 | 1.39 | 1.39 |
| Resolution (line/mm) | 8.5 | 8.5 | 8.5 | 7.1 | 7.5 | 7.5 |
| Sharpness | Rank 4 | Rank 4 | Rank 4 | Rank 4 | Rank 4 | Rank 4 |
| Transfer efficiency (%) | 96 | 94 | 95 | 92 | 93 | 91 |
| Offset | Rank 5 | Rank 4 | Rank 5 | Rank 2 | Rank 2 | Rank 1 |

As will be evident from the above results, Developers D1–D3 (Examples 1–3) according to the present invention permits the fixation of transferred image on the transfer medium with a heat roller without causing offset phenomenon.

Example 4

Developer D1 was used. Development was carried out after the toner layer had been subjected to corona discharge treatment at 5,000 V using the apparatus shown in FIG. 2. As shown in Table 3, the resolution was improved.

TABLE 3

| Example | 1 |
|---|---|
| Developer | D1 |
| Image Density | 1.53 |
| Resolution (line/mm) | 9.6 |
| Sharpness | Rank 5 |
| Transfer efficiency (%) | 96 |
| Offset | Rank 4 |

Example 5

Developer D2 was used. Development was carried out using the apparatus shown in FIG. 2. The latent image on the photoconductor was previously wetted with silicone oil (KF-96, 300 cst; layer thickness: 0.5 $\mu$m) using the pre-wet roller 6. As shown in Table 4, the image density and the transfer efficiency were improved.

TABLE 4

| Example | 5 |
|---|---|
| Developer | D2 |
| Image Density | 1.55 |
| Resolution (line/mm) | 9.1 |
| Sharpness | Rank 5 |
| Transfer efficiency (%) | 98 |
| Offset | Rank 5 |

Example 6

Developer D3 was used. Development was carried out using the apparatus shown in FIG. 3 having an intermediate transfer drum 13 (urethane rubber, surface treated with fluorine). As shown in Table 5, the image density and the transfer efficiency were improved.

TABLE 5

| Example | 6 |
|---|---|
| Developer | D3 |
| Image Density | 1.54 |
| Resolution (line/mm) | 8.5 |
| Sharpness | Rank 5 |
| Transfer efficiency (%) | 98 |
| Offset | Rank 5 |

Example 7

Developer D3 was used. Development was carried out using the apparatus shown in FIG. 4. The photoconductor was subjected to an oil-repelling treatment (layer thickness: 2 $\mu$m) using a fluorine-acrylate block copolymer (Modayper F210 manufactured by Nippon Yushi Inc.). As shown in Table 6, the image density and the transfer efficiency were improved. The contact angle ($\theta$) of KF-96 (100 cst) was 45°.

TABLE 6

| Example | 7 |
|---|---|
| Developer | D3 |
| Image Density | 1.55 |
| Resolution (line/mm) | 7.5 |
| Sharpness | Rank 4 |
| Transfer efficiency (%) | 99 |
| Offset | Rank 5 |

Preparation of Resin

Preparation Example Da1

In a 500 ml flask equipped with a stirrer and a reflux condenser, 100 g of heterogeneous rosin having a size of 0.7% (13% unsaponified; acid value: 162; softening point: 79° C.), 200 g of epichlorohydrin and 0.1 g of chlorobenzyltrimethyl ammonium were charged and reacted at 60° C. for 4 hours. To the reaction mixture, 16 g of granular sodium hydroxide were gradually added while maintaining at 60° C. The resulting mixture was heated to 100° C. and further reacted for 2 hours. The reaction mixture was then filtered to remove salts. After removing unreacted epichlorohyrin with a rotary evaporator, remaining volatile matters were removed from the filtrate by distillation at 120° C. under 2 mmHg to obtain light yellow product of disproportionated rosin glycidyl ester (yield: 97.2%). A mixture composed of 450 parts of the disproportionated rosin glycidyl ester, 250 parts of phthalic anhydride and 90 parts of triethylene glycol was reacted at 240° C. for 4 hours in the atmosphere of $N_2$. The reaction was further continued, after addition of 5 parts of trimellitic anhydride, until Resin Da1 having a predetermined molecular weight was obtained.

Preparation Example Da2

A mixture composed of 450 parts of the disproportionated rosin glycidyl ester obtained in Preparation Example Da1 and 120 parts of bisphenol A was reacted at 180° C. for 2 hours. The reaction was continued, after addition of 135 parts of dodecenylsuccinic anhydride, at 240° C. for 3 hours and further continued after addition of 20 parts of fumarated rosin triglycidyl ester to obtain Resin Da2.

Preparation Example Da3

A mixture composed of 450 parts of the disproportionated rosin glycidyl ester obtained in Preparation Example Da1 and 100 parts of epichlorohydrin was reacted at 200° C. for 6 hours. The reaction was continued, after addition of 125 parts of maleic anhydride and 100 parts of diethylene glycol for another 6 hours at 200° C. to obtain Resin Da3.

Preparation of Developer

Preparation Example 4

The following composition was kneaded with dual rolls and then ground:

| | |
|---|---|
| Resin obtained in Preparation Example Da1 | 70 parts |
| Carbon black (Printox of Degsa Inc.) | 30 parts |
| Then, the following composition was placed in a ball mill and dispersed for 24 hours: | |
| Ground product obtained above | 50 parts |
| 20% Solution of a copolymer of laurylmethacrylate/methyl methacrylate/methacrylic acid/ glycidyl methacrylate (80/10/5/5) in KF96 (manufactured by Shinetsu Silicon, viscosity: 3 cst) | 100 parts |
| KF96 (manufactured by Shinetsu Silicon, viscosity: 50 cst) | 200 parts |

The dispersion was further mixed with 300 parts of KF96 (manufactured by Shinetsu Silicon, viscosity: 50 cst) and then dispersed for 1 hour to obtain a concentrate developer. 200 Grams of the concentrate were diluted with KF96 (manufactured by Shinetsu Silicon, viscosity: 100 cst) to obtain Developer D4.

Preparation Example 5

The following composition was kneaded with a flusher and then ground:

| | |
|---|---|
| Resin obtained in Preparation Example Da2 | 57 parts |
| 250P (polyethylene manufactured by Sanyo Kasei Inc.) | 8 parts |
| MA 60 (carbon black manufactured by Mitsubishi Chemical Co., Ltd.) | 35 parts |
| Then, the following composition was placed in a ball mill and dispersed for 24 hours: | |
| Ground product obtained above | 60 parts |
| 10 96 Solution of a copolymer of stearylmethacrylate/methyl methacrylate/methacrylic acid/ hydroxymethyl methacrylate (85/7/4/4) in KF96 (manufactured by Shinetsu Silicon, viscosity: 10 cst) | 200 parts |
| KF96 (manufactured by Shinetsu Silicon, viscosity: 30 cst) | 100 parts |

The dispersion was further mixed with 300 parts of KF96 (manufactured by Shinetsu Silicon, viscosity: 30 cst) and then dispersed for 1 hour to obtain a concentrate developer. 200 Grams of the concentrate were diluted with KF96 (manufactured by Shinetsu Silicon, viscosity: 100 cst) to obtain Developer D5.

Preparation Example 6

The following composition was kneaded with a flusher and then ground:

| | |
|---|---|
| Resin obtained in Preparation Example Da3 | 60 parts |
| AC400A (Allide Chemical Inc.) | 10 parts |
| Regal 400 (Cabott Inc.) | 30 parts |

The dispersion was further formulated in the same manner as Preparation Example 4 to obtain Developer D6.

Comparative Preparation Examples 4–6

Preparation Examples 4–6 were repeated in the same manner as described except that Isopar H was used as the diluent to obtain Comparative Developers 4–6.

Image Formation

Examples 8–10 and Comparative Examples 4–6

Image forming tests were carried out using a testing device composed of the apparatus shown in FIG. 1 and a heat roll fixing apparatus mounted thereon. The tests were performed in an oil-less mode using the Developers D4–D6 and Comparative Developers 4–6. The results were as summarized in Table 7.

TABLE 7

| Example | 8 | 9 | 10 | | | |
|---|---|---|---|---|---|---|
| Comparative Example | | | | 4 | 5 | 6 |
| Developer | D4 | D5 | D6 | Comp. 4 | Comp. 5 | Comp. 6 |
| Image Density | 1.40 | 1.40 | 1.40 | 1.30 | 1.28 | 1.29 |
| Resolution (line/mm) | 8.1 | 8.1 | 8.1 | 7.5 | 7.5 | 7.5 |
| Sharpness | Rank 4 | Rank 4 | Rank 4 | Rank 4 | Rank 4 | Rank 4 |
| Transfer efficiency (%) | 95 | 94 | 95 | 92 | 92 | 91 |
| Offset | Rank 5 | Rank 5 | Rank 5 | Rank 2 | Rank 1 | Rank 1 |

As will be evident from the above results, the developers according to the present invention permit the heat roller fixation without causing offset phenomenon.

Example 11

Developer D4 was used. Development was carried out after the toner layer had been subjected to corona discharge treatment at 5,000 V using the apparatus shown in FIG. 2. As shown in Table 8, the resolution was improved.

TABLE 8

| Example | 11 |
|---|---|
| Developer | D4 |
| Image Density | 1.44 |
| Resolution (line/mm) | 8.5 |
| Sharpness | Rank 4 |
| Transfer efficiency (%) | 96 |
| Offset | Rank 4 |

Example 12

Developer D5 was used. Development was carried out using the apparatus shown in FIG. 2. The latent image on the photoconductor was previously wetted with silicone oil (KF-96, 300 cst; layer thickness: 0.5 μm) using the pre-wet roller 6. As shown in Table 9, the image density and the transfer efficiency were improved.

TABLE 9

| Example | 12 |
|---|---|
| Developer | D5 |
| Image Density | 1.46 |
| Resolution (line/mm) | 9.5 |
| Sharpness | Rank 5 |
| Transfer efficiency (%) | 97 |
| Offset | Rank 5 |

Example 13

Developer D6 was used. Development was carried out using the apparatus shown in FIG. 3 having an intermediate transfer drum 13 (urethane rubber, surface treated with fluorine). As shown in Table 10, the image density and the transfer efficiency were improved.

TABLE 10

| Example | 13 |
|---|---|
| Developer | D6 |
| Image Density | 1.49 |
| Resolution (line/mm) | 8.8 |
| Sharpness | Rank 5 |
| Transfer efficiency (%) | 99 |
| Offset | Rank 5 |

Example 14

Developer D6 was used. Development was carried out using the apparatus shown in FIG. 4. The photoconductor was subjected to an oil-repelling treatment (layer thickness: 2 μm) using a fluorine-acrylate block copolymer (Modayper F210 manufactured by Nippon Yushi Inc.). As shown in Table 11, the image density and the transfer efficiency were improved. The contact angle (θ) of KF-96 (100 cst) was 45°.

TABLE 11

| Example | 14 |
|---|---|
| Developer | D6 |
| Image Density | 1.49 |
| Resolution (line/mm) | 7.8 |
| Sharpness | Rank 4 |
| Transfer efficiency (%) | 99 |

TABLE 11-continued

| Example | 14 |
|---|---|
| Offset | Rank 5 |

Preparation of Colorant by Flushing Method

Preparation Example C11

20 g of ammonium humate was dissolved in 200 g of water in a gallon kneader, to which 250 g of carbon black (Mitsubishi #44) was added and thoroughly mixed and dispersed in the kneader. Thereafter, 800 g of an ethylene-vinyl acetate-lauryl methacrylate (60/30/10) copolymer as an olefin resin (c) having a melt index of 25–700 were added and mixed at a temperature of about 100° C. Water was then removed from the mixture. The resulting mixture was further kneaded at about 120° C. for 4 hours, and then subjected to vacuum drying, cooling and pulverization to obtain Colorant C11.

Preparation Example C12

10 g of sodium humate was dissolved in 200 g of 20 water in a gallon kneader, to which 250 g of carbon black (Mogal A manufactured by Columbia Carbon Inc.) was added and thoroughly mixed and dispersed in the kneader. Thereafter, 600 g of Sunwax 151P and 350 g of an ethylene-vinyl acetate-methyl methacrylate-dimethylaminoethyl methacrylate (50/30/10/10) copolymer as an olefin resin (c) having a melt index of 25–700 were added and kneaded at a temperature of about 150° C. The mixture was further kneaded for 2 hours at 120° C., and then subjected to vacuum drying, cooling and pulverization to obtain Colorant C12.

Preparation Example C13

Colorant Preparation Example C11 was repeated in the same procedure as described using the following raw materials, thereby obtaining Coloratts C13.

| | |
|---|---|
| Printex V | 300 parts |
| PED521 | 500 parts |
| Ethylene-vinyl acetate-ethyl acrylate-divinylbenzene (50/20/20/10) copolymer as an olefin resin (c) having a melt index of 25–700 | 80 parts |
| Ammonium humate | 25 parts |
| Water | 150 parts |

Preparation Example C14

20 g of ammonium humate was dissolved in 200 g of water in a gallon kneader, to which 250 g of carbon black (Mitsubishi #44) was added and thoroughly mixed and dispersed in the kneader. Thereafter, 750 g of an ethylene-vinylpyridine-maleic acid (90/5/5) copolymer of Table 1, No. 1 as a resin (d) were added and mixed at a temperature of about 100° C. Water was then removed from the mixture. The resulting mixture was further kneaded at about 120° C. for 4 hours, and then subjected to vacuum drying, cooling and pulverization to obtain Colorant C14.

Preparation Example C15

10 g of sodium humate was dissolved in 200 g of water in a gallon kneader, to which 250 g of carbon black (Mogal A manufactured by Columbia Carbon Inc.) was added and thoroughly mixed and dispersed in the kneader. Thereafter, 600 g of Sunwax 151P and 300 g of an ethylene-ethyl acrylate-acrylic acid (90/5/5) copolymer of Table 1, No. 2 as a resin (d) were added and kneaded at a temperature of about 150° C. The mixture was further kneaded for 2 hours at 120° C., and then subjected to vacuum drying, cooling and pulverization to obtain Colorant C15.

Preparation Example C16

Colorant Preparation Example C14 was repeated in the same procedure as described using the following raw materials, thereby obtaining Colorants C16.

| | |
|---|---|
| Printex V | 300 parts |
| PED521 | 500 parts |
| Copolymer of Table 1, No. 3 | 80 parts |
| Ammonium humate | 25 parts |
| Water | 150 parts |

Preparation of Resin

Preparation Example Db1

In a separable flask 40 parts of toluene was charged, to which 75 parts of styrene, 20 parts of butyl methacrylate, 5 parts of maleic acid and 0.5 part of divinylbenzene were added. After the gas phase in the flask had been substituted with nitrogen gas, a solution obtained by dissolving 0.3 part of benzoyl peroxide in 10 parts of toluene was added dropwise through 30 minutes using a dropping funnel whose space had been substituted with nitrogen gas, while maintaining the temperature at 80° C. The reaction mixture was further stirred at 80° C. for 10 hours. Then, 5 parts of a toluene solution containing 0.3 part of benzoyl peroxide was added dropwise. The mixture was then heated to 90° C. and maintained at that temperature for 5 hours, thereby completing the polymerization. After cooling, the polymer was precipitated in a large amount of methanol and separated by filtration, dried at 60° C. to obtain Resin Db1 having Mw/Mn of 24 and Mw of 216,000.

Preparation Example Db2

Preparation Example Db1 was repeated in the same manner as described except that, as the monomers, 8 parts of styrene, 13 parts of butyl acrylate, 2 parts of acrylic acid and 0.3 part of divinylbenzene were used, thereby to obtain Resin Db2 having Mw/Mn of 19 and Mw of 138,000.

Preparation Example Db3

Preparation Example Db1 was repeated in the same manner as described except that, as the monomers, 20 parts of butyl acrylate, 10 parts of methacrylic acid and 0.7 part of divinylbenzene were used, thereby to obtain Resin Db3 having Mw/Mn of 40 and Mw of 324,000.

Preparation Example Db4

100 Parts of Resin Db1 and 0.5 part of iron(III)-acetyl acetone (decomposition point: 340° C.) as a decomposable metal compound were kneaded at 150° C. for 30 minutes using a roll mill, thereby obtaining crosslinked polymer (Resin Db4) having a gel content of 24 determined by using toluene as a solvent.

Preparation Example Db5

100 Parts of Resin Db2 were added to and dissolved in 100 parts of xylene while increasing the temperature thereof until 130° C. To this solution, 1 part of cobalt (III)-acetyl acetone (decomposition point: 210° C.) as a decomposable metal compound was then added and the mixture was reacted at 120° C. for 5 hours. After the reaction, xylene was removed to obtain a polymer (Resin Db5) having a gel content of less than 1%.

Preparation Example Db6

Preparation Example Db4 was repeated in the same manner as described except that 100 parts of Resin Db3 were used and that 2 parts of chromium (III) salt of salicylic acid was used as a metal compound, thereby obtaining Resin Db6 having a gel content of 32%.

Preparation of Developer

Preparation Example 7

The following composition was kneaded with dual rolls and then ground:

| | |
|---|---|
| Resin obtained in Preparation Example Db1 | 70 parts |
| Carbon black (Printex of Degsa Inc.) | 30 parts |
| Then, the following composition was placed in a ball mill and dispersed for 24 hours: | |
| Ground product obtained above | 50 parts |
| 20% Solution of a copolymer of laurylmethacrylate/methyl methacrylate/methacrylic acid/ glycidyl methacrylate (80/10/5/5) in KF96 (manufactured by Shinetsu Silicon, viscosity: 3 cst) | 100 parts |
| KF96 (manufactured by Shinetsu Silicon, viscosity: 50 cst) | 200 parts |

The dispersion was further mixed with 300 parts of KF96 (manufactured by Shinetsu Silicon, viscosity: 100 cst) and then dispersed for 1 hour to obtain a concentrate developer. 200 Grams of the concentrate were diluted with KF96 (manufactured by Shinetsu Silicon, viscosity: 100 cst) to obtain Developer D7.

Preparation Example 8

The following composition was kneaded with a flusher and then ground:

| | |
|---|---|
| Resin Da2 | 57 parts |
| 250P (polyethylene manufactured by Sanyo Kasei Inc.) | 8 parts |
| MA 60 (carbon black manufactured by Mitsubishi Chemical Co., Ltd.) | 35 parts |
| Then, the following composition was placed in a ball mill and dispersed for 24 hours: | |
| Ground product obtained above | 60 parts |
| 10 96 Solution of a copolymer of stearylmethacrylate/methyl methacrylate/methacrylic acid/ hydroxymethyl methacrylate (85/7/4/4) in KF96 (manufactured by Shinetsu Silicon, viscosity: 10 cst) | 200 parts |
| KF96 (manufactured by Shinetsu Silicon, viscosity: 100 cst) | 100 parts |

The dispersion was further formulated in the same manner as Preparation Example 7 to obtain Developer D8.

Preparation Example 9

The following composition was kneaded at 140° C. for 60 minutes with a flusher and then ground:

| | |
|---|---|
| Resin Db3 | 60 parts |
| AC400A (Allide Chemical Inc.) | 10 parts |
| Regal 400 (Cabott Inc.) | 30 parts |

The dispersion was further formulated in the same manner as Preparation Example 7 to obtain Developer D9.

Comparative Preparation Examples 7–9

Preparation Examples 7–9 were repeated in the same manner as described except that Isopar H was used as the diluent to obtain Comparative Developers 7–9.

Image Formation

Examples 15–17 and Comparative Examples 7–9

Image forming tests were carried out using a testing device composed of the apparatus shown in FIG. 1 and a heat roll fixing apparatus mounted thereon. The tests were performed in an oil-less mode using the Developers D7–D9 and Comparative Developers 7–9. The results were as summarized in Table 12.

TABLE 12

| Example | 15 | 16 | 17 | | | |
|---|---|---|---|---|---|---|
| Comparative Example | | | | 7 | 8 | 9 |
| Developer | D7 | D8 | D9 | Comp. 7 | Comp. 8 | Comp. 9 |
| Image Density | 1.40 | 1.42 | 1.43 | 1.35 | 1.33 | 1.32 |
| Resolution (line/mm) | 8.3 | 8.3 | 8.3 | 7.1 | 7.1 | 7.1 |
| Sharpness | Rank 4 | Rank 4 | Rank 4 | Rank 4 | Rank 4 | Rank 4 |
| Transfer efficiency (%) | 96 | 97 | 97 | 95 | 93 | 94 |
| Offset | Rank 4 | Rank 5 | Rank 5 | Rank 2 | Rank 2 | Rank 2 |

As will be evident from the above results, the developers according to the present invention permit the heat roller fixation without causing offset phenomenon.

Example 18

Developer D7 was used. Development was carried out after the toner layer had been subjected to corona discharge treatment at 3,000 V using the apparatus shown in FIG. 2. As shown in Table 13, the resolution was improved.

TABLE 13

| Example | 18 |
|---|---|
| Developer | D7 |
| Image Density | 1.46 |
| Resolution (line/mm) | 9.6 |
| Sharpness | Rank 5 |

TABLE 13-continued

| Example | 18 |
|---|---|
| Transfer efficiency (%) | 97 |
| Offset | Rank 4 |

Example 19

Developer D8 was used. Development was carried out using the apparatus shown,in FIG. 2. The latent image on the photoconductor was previously wetted with silicone oil (XF-96, 300 cst; layer thickness: 0.5 $\mu$m) using the pre-wet roller 6. As shown in Table 14, the image density and the transfer efficiency were improved.

TABLE 14

| Example | 19 |
|---|---|
| Developer | D8 |
| Image Density | 1.46 |
| Resolution (line/mm) | 9.1 |
| Sharpness | Rank 5 |
| Transfer efficiency (%) | 99 |
| Offset | Rank 5 |

Example 20

Developer D9 was used. Development was carried out using the apparatus shown in FIG. 3 having an intermediate transfer drum 13 (urethane rubber, surface treated with fluorine). As shown in Table 15, the image density and the transfer efficiency were improved.

TABLE 15

| Example | 20 |
|---|---|
| Developer | D9 |
| Image Density | 1.52 |
| Resolution (line/mm) | 8.1 |
| Sharpness | Rank 5 |
| Transfer efficiency (%) | 99 |
| Offset | Rank 5 |

Example 21

Developer D9 was used. Development was carried out using the apparatus shown in FIG. 4. The photoconductor was subjected to an oil-repelling treatment (layer thickness: 3 $\mu$m) using a fluorine-acrylate block copolymer (Modayper F210 manufactured by Nippon Yushi Inc.). As shown in Table 16, the image density and the transfer efficiency were improved. The contact angle ($\theta$) of KF-96 (100 cst) was 45°.

TABLE 16

| Example | 21 |
|---|---|
| Developer | D9 |
| Image Density | 1.50 |
| Resolution (line/mm) | 8.1 |
| Sharpness | Rank 4 |
| Transfer efficiency (%) | 99 |
| Offset | Rank 5 |

Examples of developers using a toner containing (c) an olefin resin having a melt index of 2.5–700 will be shown below.

Preparation of Developer

Preparation Example 10

The following composition was placed in a ball mill and dispersed for 24 hours:

| | |
|---|---|
| Colorant C11 | 60 parts |
| 25% Solution of a copolymer of laurylmethacrylate/methyl methacrylate/methacrylic acid/ glycidyl methacrylate (80/10/5/5) in KF96 (manufactured by Shinetsu Silicon, viscosity: 10 cst) | 110 parts |
| KF96 (manufactured by Shinetsu Silicon, viscosity: 100 cst) | 220 parts |

The dispersion was further mixed with 300 parts of KF96 (manufactured by Shinetsu Silicon, viscosity: 100 cst) and then dispersed for 1 hour to obtain a concentrate toner. 200 Grams of the concentrate were diluted with KF96 (manufactured by Shinetsu Silicon, viscosity: 100 cst) to obtain Developer D10.

Preparation Example 11

The following composition was treated in the same manner as that in Preparation Example 10 to obtain Developer D11:

| | |
|---|---|
| Colorant C12 | 70 parts |
| 10% Solution of a copolymer of stearyl methacrylate/methyl methacrylate/methacrylic acid/ hydroxymethyl methacrylate (85/7/4/4) in KF96 (manufactured by Shinetsu Silicon, viscosity: 10 cst) | 250 parts |
| KF96 (manufactured by Shinetsu Silicon, viscosity: 10 cst) | 110 parts |

Preparation Example 12

Preparation Example 10 was repeated in the same manner as described except that Colorant C13 was substituted for Colorant 11 to obtain Developer D12.

Comparative Preparation Examples 10–12

Preparation Examples 10–12 were repeated in the same manner as described except that Isopar H was used as the diluent to obtain Comparative Developers 10–12.

Image Formation

Examples 22–24 and Comparative Examples 10–12

Image forming tests were carried out using a testing device composed of the apparatus shown in FIG. 1 and a heat roll fixing apparatus mounted thereon. The tests were performed in an oil-less mode using the Developers D10–D12 and Comparative Developers 10–12. The results were as summarized in Table 17.

TABLE 17

| Example | 22 | 23 | 24 | | | |
|---|---|---|---|---|---|---|
| Comparative Example | | | | 10 | 11 | 12 |
| Developer | D10 | D11 | D12 | Comp. 10 | Comp 11 | Comp. 12 |
| Image Density | 1.43 | 1.41 | 1.43 | 1.36 | 1.36 | 1.32 |
| Resolution (line/mm) | 8.1 | 8.3 | 8.1 | 7.5 | 7.5 | 7.5 |
| Sharpness | Rank 4 | Rank 4 | Rank 4 | Rank 4 | Rank 4 | Rank 4 |
| Transfer efficiency (%) | 93 | 94 | 95 | 91 | 90 | 90 |
| Offset | Rank 4 | Rank 4 | Rank 5 | Rank 2 | Rank 2 | Rank 2 |

As will be evident from the above results, the developers according to the present invention permit the heat fixation with a heat roller without causing offset phenomenon.

Example 25

Developer D10 was used. Development was carried out after the toner layer had been subjected to corona discharge treatment at 5,000 V using the apparatus shown in FIG. 2. As shown in Table 18, the resolution was improved.

TABLE 18

| Example | 25 |
|---|---|
| Developer | D10 |
| Image Density | 1.50 |
| Resolution (line/mm) | 9.3 |
| Sharpness | Rank 5 |
| Transfer efficiency (%) | 96 |
| Offset | Rank 4 |

Example 26

Developer D11 was used. Development was carried out using the apparatus shown in FIG. 2. The latent image on the photoconductor was previously wetted with silicone oil (KF-96, 300 cst; layer thickness: 0.5 $\mu$m) using the pre-wet roller 6. As shown in Table 19, the image density and the transfer efficiency were improved.

TABLE 19

| Example | 26 |
|---|---|
| Developer | D1 |
| Image Density | 1.53 |
| Resolution | 9.1 |

TABLE 19-continued

| Example | 26 |
|---|---|
| (line/mm) | |
| Sharpness | Rank 5 |
| Transfer efficiency (%) | 99 |
| Offset | Rank 5 |

Example 27

Developer D12 was used. Development was carried out using the apparatus shown in FIG. 3 having an intermediate transfer drum 13 (urethane rubber, surface treated with fluorine). As shown in Table 20, the image density and the transfer efficiency were improved.

TABLE 20

| Example | 27 |
|---|---|
| Developer | D12 |
| Image Density | 1.54 |
| Resolution (line/mm) | 8.5 |
| Sharpness | Rank 5 |
| Transfer efficiency (%) | 99 |
| Offset | Rank 5 |

Example 28

Developer D12 was used. Development was carried out using the apparatus shown in FIG. 4. The photoconductor was subjected to an oil-repelling treatment (layer thickness: 2 $\mu$m) using a fluorine-acrylate block copolymer (Modayper F210 manufactured by Nippon Yushi Inc.). As shown in Table 21, the image density and the transfer efficiency were improved. The contact angle (θ) of KF-96 (100 cst) was 45°.

TABLE 21

| Example | 28 |
|---|---|
| Developer | D12 |
| Image Density | 1.55 |
| Resolution (line/mm) | 7.5 |
| Sharpness | Rank 5 |
| Transfer efficiency (%) | 99 |
| Offset | Rank 5 |

Examples of developers using a toner containing (d) a polyolefin copolymer having an acid value of 0.5–80 and a melt viscosity at 200° C. of 50–20,000 mPa·s are shown below.

Preparation of Developer

Preparation Example 13

The following composition was placed in a ball mill and dispersed for 24 hours:

| | |
|---|---|
| Colorant C14 | 60 parts |
| 20% Solution of a copolymer of laurylmethacrylate/methyl methacrylate/methacrylic acid/glycidyl methacrylate (80/10/5/5) in KF96 (manufactured by Shinetsu Silicon, viscosity: 10 cst) | 100 parts |
| KF96 (manufactured by Shinetsu Silicon, viscosity: 100 cst) | 200 parts |

The dispersion was further mixed with 300 parts of KF96 (manufactured by Shinetsu Silicon, viscosity: 100 cst) and then dispersed for 1 hour to obtain a concentrate toner. 200 Grams of the concentrate were diluted with KF96 (manufactured by Shinetsu Silicon, viscosity: 100 cst) to obtain Developer D13.

Preparation Example 14

The following composition was treated in the same manner as that in Preparation Example 13 to obtain Developer D14:

| | |
|---|---|
| Colorant C15 | 50 parts |
| 10% Solution of a copolymer of stearyl methacrylate/methyl methacrylate/methacrylic acid/hydroxymethyl methacrylate (85/7/4/4) in KF96 (manufactured by Shinetsu Silicon, viscosity: 10 cst) | 200 parts |
| KF96 (manufactured by Shinetsu Silicon, viscosity: 10 cst) | 100 parts |

Preparation Example 15

Preparation Example 13 was repeated in the same manner as described except that Colorant C16 was substituted for Colorant 14 to obtain Developer D15.

Comparative Preparation Examples 13–15

Preparation Examples 13–15 were repeated in the same manner as described except that Isopar H was used as the diluent to obtain Comparative Developers 13–15.

Image Formation

Examples 29–31 and Comparative Examples 13–15

Image forming tests were carried out using a testing device composed of the apparatus shown in FIG. 1 and a heat roll fixing apparatus mounted thereon. The tests were performed in an oil-less mode using the Developers D13–D15 and Comparative Developers 13–15. The results were as summarized in Table 22.

TABLE 22

| | Example | | | Comparative Example | | |
|---|---|---|---|---|---|---|
| | 29 | 30 | 31 | 13 | 14 | 15 |
| Developer | D13 | D14 | D15 | Comp. 13 | Comp. 14 | Comp. 15 |
| Image Density | 1.45 | 1.41 | 1.46 | 1.41 | 1.38 | 1.32 |
| Resolution (line/mm) | 8.3 | 8.3 | 8.3 | 7.5 | 7.5 | 7.5 |
| Sharpness | Rank 4 | Rank 4 | Rank 4 | Rank 4 | Rank 4 | Rank 4 |
| Transfer efficiency (%) | 95 | 94 | 95 | 93 | 93 | 91 |
| Offset | Rank 4 | Rank 4 | Rank 5 | Rank 2 | Rank 2 | Rank 2 |

As will be evident from the above results, the developers according to the present invention permit the heat fixation with a heat roller without causing offset phenomenon.

Example 32

Developer D13 was used. Development was carried out after the toner layer had been subjected to corona discharge treatment at 5,000 V using the apparatus shown in FIG. 2. As shown in Table 23, the resolution was improved.

TABLE 23

| Example | 32 |
|---|---|
| Developer | D13 |
| Image Density | 1.49 |
| Resolution (line/mm) | 9.3 |
| Sharpness | Rank 5 |
| Transfer efficiency (%) | 96 |
| Offset | Rank 4 |

Example 33

Developer D14 was used. Development was carried out using the apparatus shown in FIG. 2. The latent image on the photoconductor was previously wetted with silicone oil (KF-96, 300 cst; layer thickness: 0.5 $\mu$m) using the pre-wet roller 6. As shown in Table 24, the image density and the transfer efficiency were improved.

TABLE 24

| Example | 33 |
|---|---|
| Developer | D14 |
| Image Density | 1.52 |
| Resolution (line/mm) | 8.5 |
| Sharpness | Rank 5 |
| Transfer efficiency (%) | 99 |
| Offset | Rank 5 |

Example 34

Developer D15 was used. Development was carried out using the apparatus shown in FIG. 3 having an intermediate transfer drum 13 (urethane rubber, surface treated with fluorine). As shown in Table 25, the image density and the transfer efficiency were improved.

TABLE 25

| Example | 34 |
|---|---|
| Developer | D15 |
| Image Density | 1.52 |
| Resolution (line/mm) | 8.5 |
| Sharpness | Rank 5 |
| Transfer efficiency (%) | 99 |
| Offset | Rank 5 |

Example 35

Developer D15 was used. Development was carried out using the apparatus shown in FIG. 4. The photoconductor was subjected to an oil-repelling treatment (layer thickness: 2 $\mu$m) using a fluorine-acrylate block copolymer (Modayper F210 manufactured by Nippon Yushi Inc.). As shown in Table 26, the image density and the transfer efficiency were improved. The contact angle ($\theta$) of KF-96 (100 cst) was 45°.

TABLE 26

| Example | 35 |
|---|---|
| Developer | D15 |
| Image Density | 1.55 |
| Resolution (line/mm) | 7.5 |
| Sharpness | Rank 5 |
| Transfer efficiency (%) | 99 |
| Offset | Rank 5 |

Examples of developers using a toner containing (e) a polymer obtained by crosslinking a carboxyl group-containing vinyl polymer With an amine will be shown below.

Preparation of Developer

Preparation Example 16

The following composition was kneaded with dual rolls at 120° C. for 30 minutes and then ground to obtain a ground product P:

| | |
|---|---|
| Nymeen S202 (tradename of amine manufactured by Nippon Yushi Inc.) | 0.5 part |
| Copolymer of maleic acid/styrene/i-butyl acrylate (5/40/55) | 70 parts |
| Carbon black (Printex of Degsa Inc.) | 20 parts |

Then, the following composition was placed in a ball mill and dispersed for 24 hours:

| | |
|---|---|
| Ground product P | 50 parts |
| 20% Solution of a copolymer of laurylmethacrylate/methyl methacrylate/methacrylic acid/glycidyl methacrylate (80/10/5/5) in KF96 (manufactured by Shinetsu Silicon, viscosity: 10 cst) | 100 parts |
| KF96 (manufactured by Shinetsu Silicon, viscosity: 50 cst) | 200 parts |

The dispersion was further mixed with 300 parts of KF96 (manufactured by Shinetsu Silicon, viscosity: 100 cst) and then dispersed for 1 hour to obtain a concentrate developer. 200 Grams of the concentrate were diluted with KF96 (manufactured by Shinetsu Silicon, viscosity: 50 cst) to obtain Developer D16.

Preparation Example 17

The following composition was kneaded with a flusher and then ground:

| | |
|---|---|
| Nymeen S202 | 0.15 part |
| Copolymer of methacrylic acid/styrene/n-butyl acrylate (10/30/60) | 57 parts |
| 250P (polyethylene manufactured by Sanyo Kasei Inc.) | 8 parts |
| MA 60 (carbon black manufactured by Mitsubishi Chemical Co., Ltd.) | 35 parts |

Then, the following composition was placed in a ball mill and dispersed for 24 hours:

| | |
|---|---|
| Ground product P | 60 parts |
| 10% Solution of a copolymer of stearylmethacrylate/methyl methacrylate/methacrylic acid/hydroxymethyl methacrylate | 200 parts |

-continued

| | |
|---|---|
| (85/7/4/4) in KF96 (manufactured by Shinetsu Silicon, viscosity: 10 cst) | |
| KF96 (10 cst) | 100 parts |

The dispersion was further mixed with 300 parts of KF96 (10 cst) and then dispersed for 1 hour to obtain a concentrate developer. 200 Grams of the concentrate were diluted with KF96 (10 cst) to obtain Developer D17.

Preparation Example 18

The following composition was kneaded at 140° C. for 60 minutes with a flusher and then ground:

| | |
|---|---|
| Nymeen S202 | 0.2 part |
| Copolymer of maleic acid/styrene/n-butyl acrylate (8/42/50) | 60 parts |
| AC400A (Allide Chemical Inc.) | 10 parts |
| Regal 400 (Cabott Inc.) | 30 parts |

The dispersion was further formulated in the same manner as Preparation Example 17 to obtain Developer D18.

Comparative Preparation Examples 16–18

Preparation Examples 16–18 were repeated in the same manner as described except that Isopar H was used as the diluent to obtain Comparative Developers 16–18.

Image Formation

Examples 36–38 and Comparative Examples 16–18

Image forming tests were carried out using a testing device composed of the apparatus shown in FIG. 1 and a heat roll fixing apparatus mounted thereon. The tests were performed in an oil-less mode using the Developers D16-D18 and Comparative Developers 16–18. The results were as summarized in Table 27.

TABLE 27

| | Example | | | Comparative Example | | |
|---|---|---|---|---|---|---|
| | 36 | 37 | 38 | 16 | 17 | 18 |
| Developer | D16 | D17 | D18 | Comp. 16 | Comp. 17 | Comp. 18 |
| Image Density | 1.41 | 1.42 | 1.45 | 1.37 | 1.36 | 1.37 |
| Resolution (line/mm) | 8.6 | 8.6 | 8.6 | 7.1 | 7.1 | 7.1 |
| Sharpness | Rank 4 | Rank 4 | Rank 4 | Rank 4 | Rank 4 | Rank 4 |
| Transfer efficiency (%) | 97 | 97 | 97 | 95 | 93 | 94 |
| Offset | Rank 4 | Rank 5 | Rank 4 | Rank 2 | Rank 2 | Rank 2 |

As will be evident from the above results, the developers according to the present invention permit the heat roller fixation without causing offset phenomenon.

Example 39

Developer D16 was used. Development was carried out after the toner layer had been subjected to corona discharge treatment at 3,000 V using the apparatus shown in FIG. 2. As shown in Table 28, the resolution was improved.

TABLE 28

| Example | 39 |
|---|---|
| Developer | D16 |
| Image Density | 1.47 |
| Resolution (line/mm) | 9.8 |
| Sharpness | Rank 5 |
| Transfer efficiency (%) | 97 |
| Offset | Rank 4 |

Example 40

Developer D17 was used. Development was carried out using the apparatus shown in FIG. 2. The latent image on the photoconductor was previously wetted with silicone oil (XF-96, 300 cst; layer thickness: 0.5 $\mu$m) using the pre-wet roller 6. As shown in Table 29, the image density and the transfer efficiency were improved.

TABLE 29

| Example | 40 |
|---|---|
| Developer | D17 |
| Image Density | 1.48 |
| Resolution (line/mm) | 9.1 |
| Sharpness | Rank 5 |
| Transfer efficiency (%) | 97 |
| Offset | Rank 5 |

Example 41

Developer D18 was used. Development was carried out using the apparatus shown in FIG. 3 having an intermediate transfer drum 13 (urethane rubber, surface treated with fluorine). As shown in Table 30, the image density and the transfer efficiency were improved.

TABLE 30

| Example | 41 |
|---|---|
| Developer | D18 |
| Image Density | 1.56 |
| Resolution (line/mm) | 8.5 |
| Sharpness | Rank 5 |
| Transfer efficiency (%) | 99 |
| Offset | Rank 5 |

Example 42

Developer D18 was used. Development was carried out using the apparatus shown in FIG. 4. The photoconductor was subjected to an oil-repelling treatment (layer thickness: 3 $\mu$m) using a fluorine-acrylate block copolymer (Modayper F210 manufactured by Nippon Yushi Inc.). As shown in Table 31, the image density and the transfer efficiency were improved. The contact angle ($\theta$) of KF-96 (100 cst) was 45°.

TABLE 31

| Example | 42 |
|---|---|
| Developer | D18 |
| Image Density | 1.50 |
| Resolution (line/mm) | 7.1 |
| Sharpness | Rank 4 |

TABLE 31-continued

| Example | 42 |
|---|---|
| Transfer efficient (%) | 99 |
| Offset | Rank 5 |

Examples of developers using a carrier liquid of a mixed liquid containing silicone oil and fluorine oil and having a high resistivity and a low dielectric constant in conjunction with a toner containing (e) a polymer obtained by crosslinking a carboxyl group-containing vinyl polymer with an amine will be shown below.

Preparation of Developer

Preparation Example 19

The following composition was kneaded with dual rolls at 120° C. for 30 minutes and then ground to obtain a ground product P:

| | |
|---|---|
| Nymeen S202 (tradename of amine manufactured by Nippon Yushi Inc.) | 0.5 part |
| Copolymer of maleic acid/styrene/i-butyl acrylate (5/40/55) | 70 parts |
| Carbon black (Printex of Degsa Inc.) | 20 parts |

Then, the following composition was placed in a ball mill and dispersed for 24 hours:

| | |
|---|---|
| Ground product P | 50 parts |
| 20% Solution of a copolymer of laurylmethacrylate/methyl methacrylate/methacrylic acid/glycidyl methacrylate (80/10/5/5) in KF-96 (manufactured by Shinetsu Silicon, viscosity: 10 cst) | 100 parts |
| KF-96 (manufactured by Shinetsu Silicon, viscosity: 50 cst) | 200 parts |

The dispersion was further mixed with 300 parts of KF-96 (50 cst) and then dispersed for 1 hour to obtain a concentrate developer. 200 Grams of the concentrate were diluted with a mixed solvent containing 50% of Fluorinate FC-72 (manufactured by Sumitomo 3M Inc.) and 50% of KF96 (50 cst) to obtain Developer D19.

Preparation Example 20

The following composition was kneaded with a flusher and then ground:

| | |
|---|---|
| Nyrneen S202 | 0.15 part |
| Copolymer of methacrylic acid/styrene/n-butyl acrylate (10/30/60) | 57 parts |
| 250P (polyethylene manufactured by Sanyo Kasei Inc.) | 8 parts |
| MA 60 (carbon black manufactured by Mitsubishi Chemical Co., Ltd.) | 35 parts |

Then, the following composition was placed in a ball mill and dispersed for 24 hours:

| | |
|---|---|
| Ground product P | 60 parts |
| 10% Solution of a copolymer of stearylmethacrylate/methyl methacrylate/methacrylic acid/hydroxymethyl methacrylate (85/7/4/4) in KF96 (manufactured by Shinetsu Silicon, viscosity: 10 cst) | 200 parts |
| KF96 (10 cst) | 100 parts |

The dispersion was further mixed with 300 parts of Isopar and then dispersed for 1 hour to obtain a concentrate developer. 200 Grams of the concentrate were diluted with mixed solvent containing 50% of Fluorinate FC-72 (manufactured by Sumitomo 3M Inc.) and 50% of KF96 (50 cst) to obtain Developer D20.

Preparation Example 21

The following composition was kneaded at 140° C. for 60 minutes with a flusher and then ground:

| | |
|---|---|
| Nymeen S202 | 0.2 part |
| Copolymer of rnaleic acid/styrene/n-butyl acrylate (8/42/50) | 60 parts |
| AC400A (Allide Chemical Inc.) | 10 parts |
| Regal 400 (Cabott Inc.) | 30 parts |

The dispersion was further formulated in the same manner as Preparation Example 20 to obtain Developer D21.

Comparative Preparation Examples 19–21

Preparation Examples 19–21 were repeated in the same manner as described except that Isopar H was used as the diluent to obtain Comparative Developers 19–21.

Image Formation

Examples 43–45 and Comparative Examples 19–21

Image forming tests were carried out using a testing device composed of the apparatus shown in FIG. 1 and a heat roll fixing apparatus mounted thereon. The tests were performed in an oil-less mode using the Developers D19–D21 and Comparative Developers 19–21. The results were as summarized in Table 32.

TABLE 32

| | Example | | | Comparative Example | | |
|---|---|---|---|---|---|---|
| | 43 | 44 | 45 | 19 | 20 | 21 |
| Developer | D19 | D20 | D21 | Comp. | Comp. | Comp. |
| Image Density | 1.42 | 1.43 | 1.40 | 1.35 | 1.38 | 1.37 |
| Resolution (line/mm) | 8.1 | 8.1 | 8.1 | 8.1 | 8.1 | 8.1 |
| Sharpness | Rank 4 | Rank 4 | Rank 4 | Rank 4 | Rank 4 | Rank 4 |
| Transfer efficiency (%) | 97 | 96 | 96 | 94 | 95 | 94 |
| Offset | Rank 4 | Rank 4 | Rank 4 | Rank 2 | Rank 2 | Rank 2 |

As will be evident from the above results, the developers according to the present invention permit the heat roller fixation without causing offset phenomenon.

Example 46

Developer D19 was used. Development was carried out after the toner layer had been subjected to corona discharge treatment at 3,000 V using the apparatus shown in FIG. 2. As shown in Table 33, the resolution was improved.

TABLE 33

| Example | 46 |
|---|---|
| Developer | D19 |
| Image Density | 1.48 |
| Resolution (line/mm) | 9.0 |
| Sharpness | Rank 5 |
| Transfer efficiency (%) | 97 |
| Offset | Rank 4 |

Example 47

Developer D20 was used. Development was carried out using the apparatus shown[]in FIG. 2. The latent image on the photoconductor was previously wetted with silicone oil (XF-96, 300 cst; layer thickness: 0.5 μm) using the pre-wet roller 6. As shown in Table 34, the image density and the transfer efficiency were improved.

TABLE 29

| Example | 47 |
|---|---|
| Developer | D20 |
| Image Density | 1.45 |
| Resolution (line/mm) | 9.3 |
| Sharpness | Rank 5 |
| Transfer efficiency (%) | 99 |
| Offset | Rank 5 |

Example 48

Developer D21 was used. Development was carried out using the apparatus shown in FIG. 3 having an intermediate transfer drum 13 (urethane rubber, surface treated with fluorine). As shown in Table 35, the image density and the transfer efficiency were improved.

TABLE 35

| Example | 48 |
|---|---|
| Developer | D21 |
| Image Density | 1.55 |
| Resolution (line/mm) | 8.1 |
| Sharpness | Rank 5 |
| Transfer efficiency (%) | 99 |
| Offset | Rank 5 |

Example 49

Developer D21 was used. Development was carried out using the apparatus shown in FIG. 4. The photoconductor was subjected to an oil-repelling treatment (layer thickness: 3 μm) using a fluorine-acrylate block copolymer (Modayper F210 manufactured by Nippon Yushi Inc.). As shown in Table 36, the image density and the transfer efficiency were improved. The contact angle (θ) of KF-96 (100 cst) was 45°.

TABLE 36

| Example | 49 |
|---|---|
| Developer | D21 |
| Image Density | 1.51 |

TABLE 36-continued

| Example | 49 |
|---|---|
| Resolution (line/mm) | 7.3 |
| Sharpness | Rank 4 |
| Transfer efficiency (%) | 99 |
| Offset | Rank 5 |

Examples of developers using a toner containing (f) a vinyl polymer containing at least 0.005% by weight of a crosslinking agent monomer based on total monomer will be shown below.

Preparation of Resin

Preparation Example Df1

A polymeriable composition containing styrene, n-butyl acrylate and ethyleneglycol dimethacrylate with a weight ratio of 80:20:1 was polymerized by an ordinary suspension polymerization method using 2,2-azobis(2,4-dimethylvaleronitrile) to obtain a crosslinked copolymer (Resin Df1) having a softening point of 135° C.

Preparation Example Df2

A polymeriable composition containing styrene, n-butyl acrylate and ethyleneglycol dimethacrylate with a weight ratio of 85:15:0.5 was polymerized by an ordinary suspension polymerization method using 2,2-azobis(2,4-dimethylvaleronitrile) to obtain a crosslinked copolymer (Resin Df2) having a softening point of 134° C.

Preparation Example Da3

A polymeriable composition containing styrene, n-butyl acrylate, ethyleneglycol dimethacrylate and α-methylstyrene with a weight ratio of 80:20:5:7 was polymerized in the same manner as that in Preparation Example Df1 to obtain a crosslinked copolymer (Resin Df3) having a softening point of 140° C.

Preparation of Developer

Preparation Example 22

The following composition was kneaded with dual rolls and then ground:

| | |
|---|---|
| Resin obtained in Preparation Example Df1 | 70 parts |
| Carbon black (Printex of Degsa Inc.) | 30 parts |

Then, the following composition was placed in a ball mill and dispersed for 24 hours:

| | |
|---|---|
| Ground product obtained above | 50 parts |
| Solution of a copolymer of laurylmethacrylate/methyl methacrylate/methacrylic acid/glycidyl methacrylate (80/10/5/5) in KF9G (manufactured by Shinetsu Silicon, viscosity: 10 cst) | 100 parts |
| KF96 (manufactured by Shinetsu Silicon, viscosity: 100 cst) | 200 parts |

The dispersion was further mixed with 300 parts of KF96 (manufactured by Shinetsu Silicon, viscosity: 100 cst) and then dispersed for 1 hour to obtain a concentrate developer.

200 Grams of the concentrate were diluted with KF96 (manufactured by Shinetsu Silicon, viscosity: 100 cst) to obtain Developer D22.

Preparation Example 23

The following composition was kneaded with a flusher and then ground:

| | |
|---|---|
| Resin Df2 | 57 parts |
| 250P (polyethylene manufactured by Sanyo Kasei Inc.) | 8 parts |
| MA 60 (carbon black manufactured by Mitsubishi Chemical Co., Ltd.) | 35 parts |

Then, the following composition was treated in the same manner as that in Preparation Example 22 to obtain Developer D23:

| | |
|---|---|
| Ground product obtained above | 60 parts |
| 10% Solution of a copolymer of stearylmethacrylate/methyl methacrylate/methacrylic acid/hydroxymethyl methacrylate (85/7/4/4) in KF96 (manufactured by Shinetsu Silicon, viscosity: 10 cst) | 200 parts |
| KF96 (manufactured by Shinetsu Silicon, viscosity: 50 cst) | 100 parts |

Preparation Example 24

The following composition was kneaded with a flusher and then ground:

| | |
|---|---|
| Resin Df3 | 60 parts |
| AC400A (Allide Chemical Inc.) | 10 parts |
| Regal 400 (Cabott Inc.) | 30 parts |

The dispersion was further formulated in the same manner as Preparation Example 22 to obtain Developer D24.

Comparative Preparation Examples 22–24

Preparation Examples 22–24 were repeated in the same manner as described except that Isopar H was used as the diluent to obtain Comparative Developers 22–24.

Image Formation

Examples 50–56 and Comparative Examples 22–24

Image forming tests were carried outusing a testing device composed of the apparatus shown in FIG. 1 and a heat roll fixing apparatus mounted thereon. The tests were performed in an oil-less mode using the Developers D22–D24 and Comparative Developers 22–24. The results were as summarized in Table 37.

TABLE 37

| | Example | | | Comparative Example | | |
|---|---|---|---|---|---|---|
| | 50 | 51 | 52 | 22 | 23 | 24 |
| Developer | D4 | D5 | D6 | Comp. 4 | Comp. 5 | Comp. 6 |
| Image Density | 1.38 | 1.36 | 1.33 | 1.29 | 1.28 | 1.28 |

TABLE 37-continued

| | Example | | | Comparative Example | | |
|---|---|---|---|---|---|---|
| | 50 | 51 | 52 | 22 | 23 | 24 |
| Resolution (line/mm) | 8.1 | 8.1 | 8.1 | 7.5 | 7.5 | 7.5 |
| Sharpness | Rank 4 | Rank 4 | Rank 4 | Rank 4 | Rank 4 | Rank 4 |
| Transfer efficiency (%) | 95 | 94 | 95 | 92 | 92 | 91 |
| Offset | Rank 5 | Rank 5 | Rank 5 | Rank 2 | Rank 2 | Rank 1 |

As will be evident from the above results, the developers according to the present invention permit the heat roller fixation without causing offset phenomenon.

Example 53

Developer D21 was used. Development was carried out after the toner layer had been subjected to corona discharge treatment at 5,000 V using the apparatus shown in FIG. 2. As shown in Table 38, the resolution was improved.

TABLE 38

| Example | 53 |
|---|---|
| Developer | D21 |
| Image Density | 1.38 |
| Resolution (line/mm) | 9.5 |
| Sharpness | Rank 5 |
| Transfer efficiency (%) | 96 |
| Offset | Rank 4 |

Example 54

Developer D23 was used. Development was carried out using the apparatus shown in FIG. 2. The latent image on the photoconductor was previously wetted with silicone oil (KF-96, 300 cst; layer thickness: 0.5 $\mu$m) using the pre-wet roller 6. As shown in Table 39, the image density and the transfer efficiency were improved.

TABLE 39

| Example | 54 |
|---|---|
| Developer | D23 |
| Image Density | 1.45 |
| Resolution (line/mm) | 9.3 |
| Sharpness | Rank 5 |
| Transfer efficiency (%) | 99 |
| Offset | Rank 5 |

Example 55

Developer D24 was used. Development was carried out using the apparatus shown in FIG. 3 having an intermediate transfer drum 13 (urethane rubber, surface treated with fluorine). As shown in Table 40, the image density and the transfer efficiency were improved.

TABLE 40

| Example | 55 |
|---|---|
| Developer | D24 |
| Image Density | 1.42 |

TABLE 40-continued

| Example | 55 |
|---|---|
| Resolution (line/mm) | 8.1 |
| Sharpness | Rank 5 |
| Transfer efficiency (%) | 99 |
| Offset | Rank 5 |

Example 56

Developer D24 was used. Development was carried out using the apparatus shown in FIG. 4. The photoconductor was subjected to an oil-repelling treatment (layer thickness: 2 μm) using a fluorine-acrylate block copolymer (Modayper F210 manufactured by Nippon Yushi Inc.). As shown in Table 41, the image density and the transfer efficiency were improved. The contact angle (θ) of KF-96 (100 cst) was 45°.

TABLE 41

| Example | 56 |
|---|---|
| Developer | D24 |
| Image Density | 1.44 |
| Density | |
| Resolution (line/mm) | 7.8 |
| Sharpness | Rank 4 |
| Transfer efficiency (%) | 99 |
| Offset | Rank 5 |

Examples of developers using a toner containing (g) a silicone copolymer, silicone rubber or silicone-modified resin will be shown below.

Preparation of Resin

Preparation Examples Dg1–Dg4 and Comparative Example

In a vessel equipped with a stirrer, a thermometer and a reflux condenser, 300 g of a polymerization solvent was charged. After heating the solvent to 95° C., a mixture containing 50 g of 2-ethylhexyl methacrylate, 50 g of glycidyl methacrylate, 10 g of acrylic acid, 175 g of a reactive silicone compound (X22-5002 (ME: 421) manufactured by Shinetsu Chemical Co., Ltd.) and 3 g of azobis(i-butylonitrile) was added dropwise through 1 hour. The mixture was further polymerized at 95° C. for 4 hours. The polymer thus obtained was precipitated by methanol and the precipitate was dissolved in toluene. Such dissolution and precipitation procedure was repeated thrice and the thus purified product was dried, thereby obtaining Resins Dg1–Dg4 and Comparative Resin. Each of the resins was measured for its water repellency, oil repellency and dispersibility, to give the results summarized in Table 42. Polymerization degrees are also shown in Table 42. Comparative Example was a case in which Preparation Example Dg1 was carried out without using X22-5002.

TABLE 42

| Preparation Example | Comparative Example | Dg1 | Dg2 | Dg3 | Dg4 |
|---|---|---|---|---|---|
| Polymerization Solvent | none | DMS*1 | CPS*2 | AMS*3 | HFE*4 |
| Polymerization Degree | 83.8 | 90.1 | 91.2 | 85.4 | 96.0 |
| Water Repellency (degree) | 10.0 | 47.2 | 53.6 | 40.0 | 38.0 |
| Oil Repellency (degree) | 5.2 | 37.4 | 65.0 | 55.4 | 50.9 |
| Dispersibility | C | A | A | A | A |

*1 DMS: dimethylsilicone oil
*2 CPS: cyclic polydimethylsiloxane
*3 AMS: amino-modified silicone oil
*4 HFE: higher fatty acid ester (Salacos 99 manufactured by Nissin Seiyu Inc.)

Methods for the measurement of polymerization degree, water repellency, oil repellency and dispersibility are as follows:

Polymerization Degree (solid matters of resin/theoretical solid matters)×100%

Water Repellency

Contact angle of the resin surface against ion exchanged water is measured with a contact angle meter manufactured by Kyowa Kagaku Co., Ltd.

Oil Repellency

Contact angle of the resin surface against isododecane is measured with a contact angle meter manufactured by Kyowa Kagaku Co., Ltd.

Dispersibility

After 3 months storage at 50° C., dispersibility is evaluated with naked eyes on the basis of the following ratings:

A: no sedimentation

B: separation

C: significant precipitation

Preparation of Colorant

Preparation Example C17

Colorant Preparation Example C11 was repeated in the same manner as described except that 800 g of Resin Dg1 was used in place of the olefin resin (1), thereby obtaining Colorant C17.

Preparation Example C18

Colorant Preparation Example C15 was repeated in the same manner as described except that 100 g of Resin Dg3 was added, thereby obtaining Colorant C18.

Preparation of Developer

Preparation Example 25

Preparation Example 7 was repeated in the same manner as described except that Resin Dg2 was used in place of Resin Db1, thereby obtaining Developer D25.

Preparation Example 26

Preparation Example 10 was repeated in the same manner as described except that Colorant C18 was used in place of Colorant 11, thereby obtaining Developer D26.

Preparation Example 27

Preparation Example 14 was repeated in the same manner as described except that 50 parts of Resin Dg4 was added to Developer D14.

Preparation Example 28

Preparation Example 7 was repeated in the same manner as described except that 20 parts of silicone rubber (manufactured by Shinetsu Kagaku Co., Ltd.) was added to Developer D7.

Image Formation

Examples 57–60

Image forming tests were carried out using a testing device composed of the apparatus shown in FIG. 1 and a heat roll fixing apparatus mounted thereon. The tests were performed in an oil-less mode using the Developers D25–D28. The results were as summarized in Table 43.

TABLE 43

| Example | 57 | 58 | 59 | 60 |
|---|---|---|---|---|
| Developer | D25 | D26 | D27 | D28 |
| Image Density | 1.42 | 1.43 | 1.42 | 1.29 |
| Resolution (line/mm) | 8.3 | 8.1 | 8.3 | 8.3 |
| Sharpness | Rank 4 | Rank 4 | Rank 4 | Rank 5 |
| Transfer efficiency (%) | 97 | 94 | 95 | 96 |
| Offset | Rank 5 | Rank 5 | Rank 5 | Rank 5 |

As will be evident from the above results, the developers according to the present invention give improved image density, resolution, sharpness, transfer efficiency and offset.

Example 61

20 Parts of carbon black (MA-11 of Mitsubishi Chemical Co., Ltd.), 30 parts of polystyrene, 50 parts of polylauryl methacrylate and 500 parts of Isopar V (dispersing medium) were dispersed with a keddy mill for 5 hours to obtain a liquid toner having an average particle diameter of 0.35 μm and 10.5 μm. Copies were produced using an apparatus shown in FIG. 1 thereby obtaining an image having an image density of 1.28, resolution of 6.3 lines/mm and gradient of 7 steps.

Example 62

Example 61 was repeated in the same manner as described except that toner on the developing roller in the copying machine of FIG. 1 was subjected to corona discharge of 1 kV at H, thereby obtaining an image having an image density of 1.35, resolution of 7.3 lines/mm and gradient of 8 steps and having good sharpness.

Example 63

Example 61 was repeated in the same manner as described except that the latent image on the photoconductor was previously wet with Ispar V (manufactured by Exxon Chemical Inc.) using a pre-wet roller F, thereby obtaining an image having an image density of 1.44, resolution of 7.6 lines/mm and gradient of 9 steps and having reduced background stains.

Example 64

Copies were produced with the liquid toner of Example 61 using a copying apparatus shown in FIG. 3 and having an intermediate transfer drum M, thereby obtaining an image having an image density of 1.40, resolution of 7.0 lines/mm and gradient of 9 steps and having reduced background stains.

Example 65

Example 61 was repeated in the same manner as described except that the photoconductor used was subjected to an oil repelling treatment using a fluorine-acrylate block copolymer having a thickness of 1.5 μm. The contact angle θ against Isopar V was 59°. Copies having an image density of 1.41, resolution of 7.6 lines/mm and having reduced background stains were obtained. The fixation was 81%.

Example 66

80 Parts of rosin-modified maleic acid resin and 20 parts of copper phthalocyanine blue were kneaded at 120° C. and ground into powder. 100 Parts of the thus obtained powder, 150 parts of silicone acrylic resin, 50 parts of copper phthalocyanine blue, 1000 parts of silicone oil KF-96 (50 cst, manufactured by Shinetsu Kagaku Co., Ltd.) and 10 parts of manganese naphthenate were dispersed with a basket mill to obtain a liquid toner having about 65% by weight of particles having an average particle diameter of 0.5 μm (softening point: 65° C.) and 35% by weight of particles having an average particle diameter of 18 μm (softening point: 140° C.). Copies were produced using an apparatus shown in FIG. 1 thereby obtaining an image having an image density of 1.32, resolution of 6.8 lines/mm and gradient of 7 steps and having good uniformity in black solid images. The softening point was measured using a ring and ball method.

Example 67

Example 66 was repeated in the same manner as described except that toner on the developing roller in the copying machine of FIG. 1 was subjected to corona discharge of 1.5 kV at H, thereby obtaining an image having an image density of 1.38, resolution of 7.6 lines/mm and gradient of 8 steps and having good dot image reproducibility.

Example 68

Example 61 was repeated in the same manner as described except that the latent image on the photoconductor was previously wet with silicone oil KF-96 (50 cst) using a pre-wet roller F, thereby obtaining an image having an image density of 1.48, resolution of 7.0 lines/mm and having good uniformity in balck solid images and good dot image reproducibility.

Example 69

Flush fixation was performed using the toner of Examples 61–68. Semi-gloss copies with good fixation were obtained.

Example 70

70 Parts of methyl methacrylate/ethyleneglycol dimethacrylate/vinylpyrrolidone copolymer, 1 part of zinc salicylate and 10 parts of carbon MA-11 were mixed to obtain toners having average particle diameters of 4.5 μm and 18.5 μm. The toners were mixed with a blending ratio of 80 parts to 20 parts (18.5 μm). Copies were produced using a dry-type copying apparatus (modified apparatus) shown in FIG. 1 thereby obtaining an image having an image density of 1.48, resolution of 5.6 lines/mm and gradient of 7 steps. Semi-gloss images were obtained by flush fixation without forming voids. No background stains due to filming were caused and high quality images were obtained.

Example 71

500 Parts of Isopar H as a polymerization solvent was placed in a reactor and heated to 90° C. A completely dissolved mixture containing 100 parts of LMA (lauryl methacrylate), 10 parts of GMA (glycidyl methacrylate) and 2 parts of BPO (benzoyl peroxide) was added dropwise in the reactor through 3 hours. After completion of the addition, the mixture was further polymerized for 6 hous at 90° C. To the resulting mixture, 5 parts of MAA (methacrylic acid) were added dropwise through 1 hour. To the resulting mixture, a mixture containing 130 parts of MMA (methacrylic acid), 30 parts of Pigment Red 146 (Naphthol Carmine FFB of Fuji Pigment Inc.) and 5 parts of AIBN (azobis(isobutylonitrile)) was added dropwise at 80° C. through 2 hours. The Pigment Red 146 was used after having been activated by drying at 100° C. in a vacuum oven followed by UV irradiation. After completion of the drip, the mixture was polymerized at 85° C. for 4 hours to obtain a red toner which was in the form of negatively charged gel particles having an average particle size of 2.3 μm and a content of Isopar of 60% by weight.

Example 72

800 Parts of Isopar H as a polymerization solvent was placed in a reactor and heated to 85° C. A completely dissolved mixture containing 80 parts of 2EHMA (2-ethylhexyl methacrylate), 30 parts of SMA (stearyl methacrylate), 7 parts of GMA (glycidyl methacrylate)and 2 parts of BPO (benzoyl peroxide) was added dropwise in the reactor through 3 hours. After completion of the addition, the mixture was further polymerized for 4 hous at 85° C. To the resulting mixture, 3 parts of MAA (methacrylic acid) were added dropwise through 1 hour. To the resulting mixture, a mixture containing 110 parts of MMA (methacrylic acid), 30 parts of Pigment Blue 15:3 (copper phthalocyanine) which had been subjected to a flushing treatment and 5 parts of AIBN (azobis(isobutylonitrile)) was added dropwise at 80° C. through 2 hours. After completion of the drip, the mixture was polymerized at 85° C. for 4 hours to obtain a blue toner which was in the form of positively charged gel particles having an average particle size of 1.8 μm and a content of Isopar of 40% by weight.

The flushing-treated Pigment Blue 15:3 was prepared as follows.

In a flusher, 50 parts of water, 20 parts of Pigment Blue 15:3 and 3 parts of ammonium humate were placed and dispersed well. To this dispersion, 80 parts of ethylene-vinyl acetate copolymer (Evaflex 210 manufactured by Mitsui du Pont Inc.) and 50 parts of toluene and the mixture was dispersed at 100° C. for 2 hours. From the resulting dispersion, water and toluene were removed in vacuo. The residues were ground to obtain a flushing coloring agent.

Example 73

To 120 parts of ethanol, 35 parts of carbon black (Cabot, Regal 330) were added and the mixture was sonicated for 50 minutes. The resulting dispersion was transferred to a reactor adapted to be evacuated. 250 Parts of toluene, 600 parts of Isopar M, styrene-methacrylate copolymer having a softening point of about 60° C. and 5 parts of manganese naphthenate were added to the reactor and heated at 90° C. for about 5 hours. After cooling to 40° C., the reactor was evacuated to vacuum of 1 mmHg to remove ethanol and toluene, thereby obtaining a black toner which was in the form of positively charged, low softening point gel particles having an average particle size of 2.1 μm and a content of Isopar of 20% by weight.

Using the toners of Examples 71–73, image formation on paper was performed by electrophotography.

Used was a developing device having a roller composed of an aluminum base and a 10 μm thick polyfluoroethylene layer provided thereon. Polymerized particles are continuously fed to form a uniform layer on this roller using an adjusting member and another roller. Commercially available OPC was used to form an electrostatic latent image by known means. The OPC was uniformly charged with a corona discharger and exposed imagewise to remove the charge in the exposed area and to retain the charge in the non-exposed area. The uniform layer of the polymerized particles was contacted with th the OPC using the above developing device. Various vias voltages were applied between the developing roller and the OPC to permit the deposition of the polymerized particles according to the latent images, thereby obtaining good images. The thus obtained images were electrostatically transferred onto commercially available PPC papers (manufactured by Ricoh Company, Ltd.). Fixation was performed using a fixing device for a laser printer (manufactured by Ricoh Company, Ltd.). Fixation was found to be performed in satisfactory manner.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all the changes which come within the meaning and range of equivalency of the claims are therefore intended to be embraced therein.

The teachings of Japanese Patent Applications No. H11-236941 (filed Aug. 24, 1999), No. H11-331437 (filed Nov. 22, 1999), No. H11-324164 (filed Nov. 15, 1999) and No. H11-283475 (filed Oct. 4, 1999) each inclusive of the specification, claims and drawings, are hereby incorporated by reference herein.

What is claimed is:

1. A liquid developer, comprising a carrier liquid, toner particles, and an erucamide compound; wherein said carrier liquid comprises silicone oil, and said toner particles comprise a coloring agent and a resin.

2. An image forming method comprising contacting an electrostatic latent image-bearing surface with a thin layer of a liquid developer to develop said electrostatic latent image, wherein said liquid developer is as recited in any one of claims 1–3.

3. The image forming method according to claim 2, wherein said thin layer of the liquid developer is formed on a developing roller or belt and wherein said contacting is performed after the thin layer of has been subjected to corona discharge.

4. The image forming method according to claim 2, wherein said electrostatic latent image is applied with a pre-wetting liquid before said contacting.

5. The image forming method according to claim 2, further comprising a step of transferring the developed image to an intermediate transferring member, a step of transferring the transferred image from said intermediate transferring member to a transfer medium, and a step of fixing the transferred image on said transfer medium.

6. The image forming method according to claim 2, wherein said electrostatic latent image-bearing surface is a water repelling and oil repelling surface of a photoconductor.

* * * * *